US011545756B2

(12) United States Patent
Qi et al.

(10) Patent No.: US 11,545,756 B2
(45) Date of Patent: Jan. 3, 2023

(54) PHASE SHIFTER, ANTENNA SYSTEM, AND COMMUNICATIONS DEVICE

(71) Applicant: Huawei Technologies Co., Ltd., Shenzhen (CN)

(72) Inventors: Meiqing Qi, Shanghai (CN); Canrong Dai, Kista (SE); Xiaofei Wei, Shanghai (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 17/118,912

(22) Filed: Dec. 11, 2020

(65) Prior Publication Data

US 2021/0098886 A1 Apr. 1, 2021

Related U.S. Application Data

(63) Continuation of application No. PCT/CN2019/084770, filed on Apr. 28, 2019.

(30) Foreign Application Priority Data

Sep. 30, 2018 (CN) ..... 201811162590.2

(51) Int. Cl.
*H01Q 3/24* (2006.01)
*H01Q 13/20* (2006.01)
*H01P 1/18* (2006.01)

(52) U.S. Cl.
CPC ..... *H01Q 13/206* (2013.01); *H01P 1/18* (2013.01); *H01P 1/184* (2013.01); *H01Q 3/24* (2013.01); *H01Q 13/20* (2013.01)

(58) Field of Classification Search
CPC ..... H01Q 13/206; H01Q 3/24; H01Q 1/50; H01Q 13/20; H01P 1/184; H01P 1/185;
(Continued)

(56) References Cited

U.S. PATENT DOCUMENTS 5,208,564 A * 5/1993 Burns ..... H01P 1/185 333/164
5,739,706 A 4/1998 Okamoto
(Continued)

FOREIGN PATENT DOCUMENTS

CN 1149740 A 5/1997
CN 1230049 A 9/1999
(Continued)

OTHER PUBLICATIONS

Lynes, G., et al., "Design of a Broad-Band 4-Bit Loaded Switched-Line Phase Shifter," IEEE Transactions on Microwave Theory and Techniques, XP001402151, vol. 22, No. 6, Jun. 1974, 5 pages.

*Primary Examiner* — Hai V Tran
(74) *Attorney, Agent, or Firm* — Conley Rose, P.C.

(57) ABSTRACT

A phase shifter includes a radio frequency input transmission line, a radio frequency output transmission line, and a first branch and a second branch coupled in parallel between the radio frequency input transmission line and the radio frequency output transmission line, the first branch includes first switch components and first transmission lines coupled in series, and the second branch includes a second transmission line including a first terminal coupled to the radio frequency input transmission line and a second terminal, a third transmission line including a third terminal coupled to the second terminal and a fourth terminal coupled to the radio frequency output transmission line, second switch components, where one terminal of each of the second switch components is coupled to a connection node of the second transmission line and the third transmission line, and the other terminal is coupled to a corresponding grounding component.

20 Claims, 16 Drawing Sheets

(58) Field of Classification Search
CPC .... H01P 1/18; H01P 1/10; H01P 1/15; H04M 1/026; H03H 7/185; H03H 11/20; H03H 7/20; H03H 11/18; H03H 11/48; H03H 19/008; G11B 15/12; G11B 2005/0013; G11B 5/02; G11B 5/09; H03K 17/16; H03K 17/661; H04L 41/0813; H04L 47/82; H04L 61/2007; H04L 61/2015; H04L 61/2038; H04L 61/2061
USPC ..... 343/702
See application file for complete search history.

(56) References Cited

U.S. PATENT DOCUMENTS

| | | | | |
|---|---|---|---|---|
| 6,252,474 | B1 * | 6/2001 | Mizutani | H03H 11/20 333/139 |
| 2003/0020563 | A1 | 1/2003 | Hieda et al. | |
| 2004/0239447 | A1 * | 12/2004 | Eom | H01P 1/185 333/164 |
| 2007/0273456 | A1 * | 11/2007 | Miyaguchi | H03H 11/48 333/164 |
| 2007/0273457 | A1 * | 11/2007 | Mizutani | H01P 1/15 333/103 |
| 2014/0152399 | A1 * | 6/2014 | Ehyaie | H03H 7/185 333/139 |
| 2017/0194688 | A1 * | 7/2017 | Sharma | H01P 5/16 |
| 2017/0230033 | A1 | 8/2017 | Shapiro et al. | |
| 2021/0098886 | A1 | 4/2021 | Qi et al. | |

FOREIGN PATENT DOCUMENTS

| | | | |
|---|---|---|---|
| CN | 2562497 | Y | 7/2003 |
| CN | 205911943 | U | 1/2017 |
| CN | 109216835 | A | 1/2019 |
| EP | 1729411 | A1 | 12/2006 |
| FR | 2606557 | A1 | 5/1988 |
| JP | H05226907 | A | 9/1993 |
| JP | H05251903 | A | 9/1993 |
| JP | 2001094302 | A | 4/2001 |
| JP | 2010016551 | A | 1/2010 |
| JP | 2010028440 | A | 2/2010 |
| JP | 2010183192 | A | 8/2010 |
| JP | 5522908 | B2 | 6/2014 |
| JP | 2014229980 | A | 12/2014 |
| KR | 100325369 | B1 | 3/2002 |
| KR | 20100058274 | A | 6/2010 |

* cited by examiner

PHASE SHIFTER, ANTENNA SYSTEM, AND COMMUNICATIONS DEVICE

CROSS-REFERENCE TO RELATED APPLICATIONS

This application is a continuation of International Patent Application No. PCT/CN2019/084770 filed on Apr. 28, 2019, which claims priority to Chinese Patent Application No. 201811162590.2 filed on Sep. 30, 2018. The disclosures of the aforementioned applications are hereby incorporated by reference in their entireties.

TECHNICAL FIELD

This application relates to the communications field, and in particular, to a phase shifter, an antenna system, and a communications device.

BACKGROUND

With development of communications technologies, a communication capacity of a fifth-generation (5G) communications technology is 1000 times higher than a communication capacity of a fourth-generation (4G) communications technology. The communication capacity is improved mainly by optimizing coding spectrum efficiency, increasing a bandwidth, increasing a quantity of antennas, and the like. The bandwidth is increased from 0 gigahertz (GHz) to 3 GHz to a millimeter wave (24/28/39/60 GHz) and 0 GHz to 6 GHz. A massive multiple-input multiple-output (MIMO) technology that increases the quantity of antennas is a key technology in hardware.

The massive MIMO has two typical architectures: digital beamforming (DBF) and digital hybrid beamforming (DHBF). The DHBF has an advantage of reducing a quantity of active channels of hardware. 64 transceiver (64TR) dual-polarized massive MIMO is used as an example. DBF needs 64 active channels, and one-driver-one-column DHBF needs only 16 active channels, and a quantity of channels is reduced by 75%. A difference between performance of the DBF and the DHBF is within 20%. Therefore, the DHBF is a preferred technical means for improving a price-performance ratio.

In a DHBF hardware topology, a phase shifter is between a power amplifier and an antenna. A circuit topology of the phase shifter in an existing solution is usually implemented based on a switch and a transmission line. Usually, a switched-line phase shifter may include two branches. One branch is used to implement a small transmission phase, and the other branch is used to implement a large transmission phase. A transmission phase difference between the two branches is a phase shift amount of the phase shifter. A length of the transmission line is usually related to the phase shift amount. A larger phase shift amount indicates a larger length of the transmission line, thereby causing a larger volume of the phase shifter. Therefore, how to reduce a size of the phase shifter is an urgent problem to be resolved.

SUMMARY

This application provides a miniaturized phase shifter, and the phase shifter is applied to an antenna system and a communications device.

According to a first aspect, this application provides a phase shifter, including a radio frequency input transmission line, a radio frequency output transmission line, and a first branch and a second branch that are located between the radio frequency input transmission line and the radio frequency output transmission line, where the first branch and the second branch are connected in parallel.

The first branch includes at least one first switch component and at least one first transmission line, and each of the at least one first switch component and each of the at least one first transmission line are connected in series.

The second branch includes a second transmission line, a third transmission line, at least one second switch component, and at least one grounding component. The at least one second switch component is in a one-to-one correspondence with the at least one grounding component. One terminal of the second transmission line is connected to the radio frequency input transmission line, the other terminal is connected to one terminal of the third transmission line, and the other terminal of the third transmission line is connected to the radio frequency output transmission line. One terminal of each second switch component is connected to a connection node of the second transmission line and the third transmission line, and the other terminal is connected to the corresponding grounding component. The at least one first switch component and the at least one second switch component are turned on or off at a same time.

In this implementation of this application, if a radio frequency signal is input on the radio frequency input transmission line, when all the first switch components and second switch components are in a turning-on state, the radio frequency signal input from the radio frequency input transmission line is transmitted to the radio frequency output transmission line using the first branch, and the first branch presents an inductor characteristic. In this case, the phase shifter presents a band-pass characteristic or a high-pass characteristic. This is equivalent to reducing an equivalent electrical length of the radio frequency signal during transmission in the phase shifter such that a delay is reduced, a phase of the radio frequency signal is advanced, and an equivalent electrical length of the phase shifter is less than a physical length of the first branch. When the at least two switch components are all in a turning-off state, the first branch is disconnected, and the second branch is connected. The radio frequency signal input from the radio frequency input transmission line is transmitted to the radio frequency output transmission line using the second branch. The first branch presents a capacitor characteristic, to implement capacitor loading on the second branch. In this case, the phase shifter presents a low-pass characteristic. This is equivalent to increasing an equivalent electrical length of the phase shifter such that a delay is increased, a phase of the radio frequency signal is lagged, and the equivalent electrical length of the phase shifter is greater than a physical length of the second branch. A transmission phase difference of the radio frequency signal in the two states is a phase shift amount of the phase shifter. Therefore, the phase shifter provided in this application has different equivalent electrical lengths in different states through inductor loading and capacitor loading, phase shift is implemented by switching a switch component in the phase shifter, and a difference between the equivalent electrical lengths of the phase shifter in the two states is greater than a difference between the physical lengths of the two branches. Therefore, the phase shifter provided in this application can implement a larger phase shift amount using a smaller size.

With reference to the first aspect, in a first possible implementation, a length of the first transmission line, a length of the second transmission line, and a length of the third transmission line are all less than or equal to a ⅛ wavelength of a radio frequency signal input from the radio frequency input transmission line.

In this implementation of this application, the length of the first transmission line, the length of the second transmission line, and the length of the third transmission line are all less than or equal to a ⅛ wavelength of the radio frequency signal input from the radio frequency input transmission line such that a smaller phase shifter can be implemented.

With reference to the first aspect or the first possible implementation of the first aspect, in a second possible implementation, when the at least one first switch component and the at least one second switch component are turned on at a same time, the second branch is equivalent to a shunt inductor of the first branch.

In this implementation of this application, the second branch may be equivalent to the shunt inductor of the first branch, and the first branch may also be equivalent to an inductor such that the phase of the radio frequency signal can be advanced. This may be understood as reducing the equivalent electrical length of the radio frequency signal during transmission such that a difference between equivalent electrical lengths of the branches is larger when states of the first switch component and the switch component in the phase shifter are switched. Therefore, the phase shifter can implement a larger transmission length difference using a smaller size, thereby further implementing a larger phase shift amount. Therefore, a larger phase shift amount can be implemented using a phase shifter of a smaller size.

With reference to the first aspect or the first possible implementation of the first aspect, in a third possible implementation, when the at least one first switch component and the at least one second switch component are turned off at a same time, the first branch is equivalent to a shunt capacitor of the second branch.

In this implementation of this application, when both the first switch component and the second switch component are in the turning-off state, the first branch may be equivalent to the shunt capacitor of the second branch, to implement capacitor loading on the second branch such that the phase of the radio frequency signal can be lagged. This is equivalent to increasing the equivalent electrical length of the radio frequency signal during transmission such that a difference between equivalent electrical lengths of the branches is larger when states of the first switch component and the switch component in the phase shifter are switched. Therefore, the phase shifter can implement a larger transmission length difference using a smaller size, thereby further implementing a larger phase shift amount. Therefore, a larger phase shift amount can be implemented using a phase shifter of a smaller size.

With reference to any one of the first aspect, or the first to the third possible implementations of the first aspect, in a fourth possible implementation, the second branch further includes K fourth transmission lines, the K fourth transmission lines are connected in series, one terminal of the K fourth transmission lines that are connected in series is connected to the other terminal of the second transmission line, and the other terminal of the K fourth transmission lines that are connected in series is connected to the one terminal of the second transmission line, a connection node is formed between every two adjacent transmission lines in the second transmission line, the K fourth transmission lines, and the second transmission line that are connected in series, and a total of K+1 connection nodes are formed, and correspondingly, there are K+1 groups of second switch components, each group includes at least one second switch component, the K fourth transmission lines are connected in series, each of the K+1 second switch components is in a one-to-one correspondence with each of the K+1 connection nodes, one terminal of each second switch component is connected to a corresponding connection node, and the other terminal is connected to a corresponding grounding component.

In this implementation of this application, the second branch further includes K fourth transmission lines, and there are K+1 second switch components such that the second branch can be connected in parallel with a plurality of second switch components. When both the first switch component and the second switch component are in the turning-on state, a quantity of shunt inductors of the transmission line on the first branch may be increased, to further enhance inductor loading on the first branch to implement a larger phase shift amount.

With reference to the fourth possible implementation of the first aspect, in a fifth possible implementation, a length of each of the K fourth transmission lines is less than a ⅛ wavelength of the radio frequency signal input from the radio frequency input transmission line.

In this implementation of this application, when the second branch is equivalent to the shunt inductor of the first branch, the length of each fourth transmission line may be further less than a ⅛ wavelength of the radio frequency signal input from the radio frequency input transmission line, to further implement a miniaturized phase shifter.

With reference to any one of the first aspect, or the first to the fifth possible implementations of the first aspect, in a sixth possible implementation, there is a fifth transmission line between the second switch component and the corresponding connection node.

In this implementation of this application, the fifth transmission line is further included between one terminal of each second switch component and the corresponding connection node such that when both the first switch component and the second switch component are in the turning-on state, each second switch component and a corresponding fifth transmission line can be equivalent to an inductor to enable the second branch to be equivalent to a shunt inductor of the first branch. Therefore, the phase shifter can implement a larger transmission length difference using a smaller size, thereby further implementing a larger phase shift amount. Therefore, a larger phase shift amount can be implemented using a phase shifter of a smaller size.

With reference to the sixth possible implementation of the first aspect, in a seventh possible implementation, a length of the fifth transmission line is less than a ⅛ wavelength of the radio frequency signal input from the radio frequency input transmission line.

In this implementation of this application, when each second switch component and a corresponding fifth transmission line can be equivalent to an inductor to enable the second branch to be equivalent to a shunt inductor of the first branch, a length of each fifth transmission line is further less than a ⅛ wavelength of the radio frequency signal input from the radio frequency input transmission line, thereby further implementing a miniaturized phase shifter.

With reference to any one of the first aspect, or the first to the seventh possible implementations of the first aspect, in an eighth possible implementation, one terminal of one of the at least one first transmission line is connected to the radio frequency input transmission line, and the other terminal is connected to one terminal of one of the at least one first switch component.

With reference to the eighth possible implementation of the first aspect, in a ninth possible implementation, one terminal of another of the at least one first transmission line is connected to the radio frequency output transmission line, and the other terminal is connected to one terminal of another of the at least one first switch component.

With reference to any one of the first aspect, or the first to the ninth possible implementations of the first aspect, in a tenth possible implementation, one terminal of each of the at least one first switch component is connected to one terminal of one of the at least one first transmission line, and the other terminal is connected to one terminal of another of the at least one first transmission line.

In this implementation of this application, a plurality of first switch components may be connected in series on the first branch such that the first branch further implements capacitor loading on the second branch. This is equivalent to further increasing the equivalent electrical length of the radio frequency signal. Therefore, the phase shifter can implement a larger transmission length difference using a smaller size, thereby further implementing a larger phase shift amount. Therefore, a larger phase shift amount can be implemented using a phase shifter of a smaller size.

With reference to any one of the first aspect, or the first to the tenth possible implementations of the first aspect, in an eleventh possible implementation, the first branch and a first part of the second branch form a loop, there is at least one direct current (DC) blocking capacitor on the loop, and the first part is a part on the second branch other than a part between each connection node and the corresponding grounding component.

In this implementation of this application, a direct current control signal is input into each of the first switch component and the second switch component. The first branch and a part of transmission lines on the second branch form a loop, and when the input control signal is transmitted on the loop, the first switch component cannot be controlled. Therefore, adding a DC blocking capacitor to the loop can prevent the first branch and the second branch from forming a loop on which a control signal is transmitted, thereby more effectively control the first switch component.

With reference to any one of the first aspect, or the first to the eleventh possible implementations of the first aspect, in a twelfth possible implementation, the at least one first switch component includes M pairs of first switch components, and in each of the M pairs of first switch components, one terminal of one first switch component is connected to one terminal of the other first switch component, where polarity of two terminals that are connected to each other and that are of one pair of first switch components is the same, and M is an integer greater than or equal to 1.

In this implementation of this application, when the first switch component is a component that has polarity, terminals that are of every two first switch components and that have same polarity may be connected to each other, to form a more effective switch component on the first branch.

With reference to any one of the first aspect, or the first to the twelfth possible implementations of the first aspect, in a thirteenth possible implementation, the at least one second switch component includes N pairs of second switch components, and in each of the N pairs of second switch components, one terminal of one second switch component is connected to one terminal of the other second switch component, where polarity of two terminals that are connected to each other and that are of one pair of second switch components is the same, and N is an integer greater than or equal to 1.

In this implementation of this application, when the second switch component is a component that has polarity, terminals that are of every two second switch components and that have same polarity may be connected to each other, to form a more effective switch component on the second branch.

With reference to any one of the first aspect, or the first to the thirteenth possible implementations of the first aspect, in a fourteenth possible implementation, any one of the at least one first transmission line, the second transmission line, and/or the third transmission line is a lumped inductor.

In this implementation of this application, when an operating frequency is relatively low, a size of the phase shifter can be further reduced, and stability of the phase shifter can be improved such that parameters such as a phase shift amount and a bandwidth of the phase shifter are more accurate.

According to a second aspect, this application provides a phase shifter, including a radio frequency input transmission line, a radio frequency output transmission line, and a first branch and a second branch that are connected in parallel and that are separately located between the radio frequency input transmission line and the radio frequency output transmission line.

The first branch includes a first switch component.

The second branch includes a second transmission line, a third transmission line, at least one second switch component, and at least one grounding component. The at least one second switch component is in a one-to-one correspondence with the at least one grounding component. One terminal of the second transmission line is connected to the radio frequency input transmission line, the other terminal is connected to one terminal of the third transmission line, and the other terminal of the third transmission line is connected to the radio frequency output transmission line. One terminal of each second switch component is connected between the other terminal of the second transmission line and the one terminal of the third transmission line, to form a connection node, and the other terminal is connected to the corresponding grounding component.

The first switch component and the at least one second switch component are turned on or off at a same time.

In this implementation of this application, when the first switch component and the second switch component are switched from a turning-on state to a turning-off state, transmission of a radio frequency signal input from the radio frequency input transmission line is switched from the first branch to the second branch such that a phase of the radio frequency signal input from the radio frequency input transmission line is lagged. When the first switch component and the second switch component are switched from a turning-off state to a turning-on state, transmission of a radio frequency signal input from the radio frequency input transmission line is switched from the second branch to the first branch such that a phase of the radio frequency signal input from the radio frequency input transmission line is advanced. Therefore, the phase shifter provided in this implementation of this application can change an equivalent electrical length of the radio frequency signal during transmission by switching the first switch component and the second switch component between the turning-on state and the turning-off state, to implement phase shift. In this way, when a switch is switched, a delay difference of the input radio frequency signal is generated between the branches, and phase shift is implemented using a switching delay and the delay difference between the branches.

With reference to the second aspect, in a first possible implementation, a length of the second transmission line and a length of the third transmission line are both less than or equal to a ⅛ wavelength of a radio frequency signal input from the radio frequency input transmission line.

In this implementation of this application, the length of the second transmission line and the length of the third transmission line are both less than or equal to a ⅛ wavelength of the radio frequency signal input from the radio frequency input transmission line such that a smaller phase shifter can be implemented.

With reference to the second aspect or the first possible implementation of the second aspect, in a second possible implementation, when the first switch component and the at least one second switch component are turned on at a same time, the second branch is equivalent to a shunt inductor of the first branch.

With reference to the second aspect or the first possible implementation of the second aspect, in a third possible implementation, when the first switch component and the at least one second switch component are turned off at a same time, after the radio frequency signal is input from the radio frequency input transmission line, the radio frequency signal passes through the second branch and is output from the radio frequency output transmission line.

In this implementation of this application, the second branch may be equivalent to the shunt inductor of the first branch, and the first branch may also be equivalent to an inductor such that the phase of the radio frequency signal can be advanced. This may be understood as reducing the equivalent electrical length of the radio frequency signal during transmission such that a difference between equivalent electrical lengths of the branches is larger when states of the first switch component and the switch component in the phase shifter are switched. Therefore, the phase shifter can implement a larger transmission length difference using a smaller size, thereby further implementing a larger phase shift amount. Therefore, a larger phase shift amount can be implemented using a phase shifter of a smaller size.

According to a third aspect, this application provides an antenna system, including an antenna and the phase shifter according to any one of the implementations of the first aspect or the second aspect, where a radio frequency output transmission line of the phase shifter is connected to the antenna.

According to a fourth aspect, this application provides a communications device, including a baseband unit, a radio frequency unit, and an antenna system, where the antenna system is the antenna system according to the third aspect, the radio frequency unit includes at least one signal transceiver channel, an input end of each of the at least one signal transceiver channel is connected to the baseband unit, and an output end of each signal transceiver channel is connected to a radio frequency input transmission line of a phase shifter in the antenna system.

In this application, the phase shifter may include the radio frequency input transmission line, the radio frequency output transmission line, and the first branch and the second branch that are located between the radio frequency input transmission line and the radio frequency output transmission line. The first branch includes the at least one first switch component and the at least one first transmission line, and the second branch includes the at least one second switch component, the second transmission line, and the third transmission line.

If the radio frequency signal is input on the radio frequency input transmission line, when both the first switch component and the second switch component are in the turning-on state, the radio frequency signal input from the radio frequency input transmission line is transmitted to the radio frequency output transmission line using the first branch, and the first branch presents the inductor characteristic. In this case, the phase shifter presents the band-pass characteristic or the high-pass characteristic. This is equivalent to reducing the equivalent electrical length of the radio frequency signal during transmission in the phase shifter such that the delay is reduced, the phase of the radio frequency signal is advanced, and the equivalent electrical length of the phase shifter is less than the physical length of the first branch.

When the at least two switch components are all in the turning-off state, the first branch is disconnected, and the second branch is connected. The radio frequency signal input from the radio frequency input transmission line is transmitted to the radio frequency output transmission line using the second branch. The first branch presents the capacitor characteristic, to implement capacitor loading on the second branch. In this case, the phase shifter presents the low-pass characteristic. This is equivalent to increasing the equivalent electrical length of the phase shifter such that the delay is increased, the phase of the radio frequency signal is lagged, and the equivalent electrical length of the phase shifter is greater than the physical length of the second branch. The transmission phase difference of the radio frequency signal in the two states is the phase shift amount of the phase shifter.

Therefore, the phase shifter provided in this application has different equivalent electrical lengths in different states through inductor loading and capacitor loading, phase shift is implemented by switching the switch component in the phase shifter, and the difference between the equivalent electrical lengths of the phase shifter in the two states is greater than the difference between the physical lengths of the two branches. Therefore, the phase shifter provided in this application can implement a larger phase shift amount using a smaller size.

DESCRIPTION OF EMBODIMENTS

Figure 1:
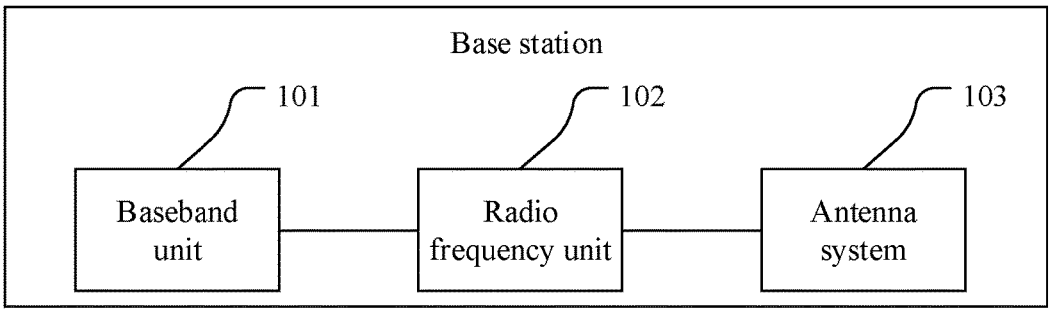
FIG. 1 is a schematic structural diagram of a base station according to an embodiment of this application.

This application provides a miniaturized phase shifter, and the phase shifter is applied to an antenna system and a communications device.

The phase shifter provided in this application may be applied to the, and the antenna system may be applied to the communications device. The communications device may be a base station, a network device with an antenna unit, or the like. For example, that the communications device is a base station is used as an example. The base station may be applied to a plurality of wireless communications systems. Specific communications systems are, for example, a code-division multiple access (CDMA) system, a time-division multiple access (TDMA) system, a frequency-division multiple access (FDMA) system, an orthogonal FDMA (OFDMA) system, a single-carrier FDMA (SC-FDMA) system, and another system. The terms "system" and "network" can be interchanged with each other. A radio technology such as Universal Terrestrial Radio Access (UTRA) or CDMA 2000 may be implemented in the CDMA system. UTRA may include a wideband CDMA (WCDMA) technology and another variation technology of CDMA. CDMA 2000 may cover the Interim Standard (IS) 2000 (IS-2000), the IS-95 standard, and the IS-856 standard. A radio technology such as a Global System for Mobile Communications (GSM) may be implemented in the TDMA system. A radio technology such as Evolved UTRA (E-UTRA), Ultra Mobile Broadband (UMB), the Institute of Electrical and Electronics Engineers (IEEE) 802.11 (Wi-Fi), IEEE 802.16 (Worldwide Interoperability for Microwave Access (WiMAX)), IEEE 802.20, or flash OFDMA may be implemented in the OFDMA system. UTRA and E-UTRA are Universal Mobile Telecommunications Service (UMTS) and an evolution version of UMTS. The 3rd Generation Partnership Project (3GPP) Long-Term Evolution (LTE) and various releases evolved based on LTE are new releases of UMTS that uses E-UTRA. A 5G communications system and New Radio (NR) are next generation communications systems under study. In addition, the communications system may be further applied to a future-oriented communications technology to which the technical solutions provided in the embodiments of this application may be applied.

Therefore, the base station provided in this application may include devices that provide a base station function in a second-generation (2G) network, a third-generation (3G) network, a 4G network, a 5G network, and a wireless local area network (WLAN). Devices that provide a base station function in the 2G network include a base transceiver station (BTS) and a base station controller (BSC). Devices that provide a base station function in the 3G network include a NodeB and a radio network controller (RNC). Devices that provide a base station function in the 4G network include an evolved NodeB (eNB). A device that provides a base station function in the WLAN is an access point (AP). Devices that provide a base station function in the 5G communications system include an eNB, an NR NodeB (gNB), a centralized unit (CU), a distributed unit, an NR controller, and the like. Typically, the base station to which the phase shifter provided in this application is applied may be a high-power macro base station in the 5G communications system, such as a millimeter-wave macro base station or a Sub6G macro base station.

The base station provided in this application may include an antenna system, and the antenna system may include a phase shifter, an element, a power splitter, and the like. The phase shifter included in the antenna system may be the phase shifter provided in this application.

For example, a structure of the base station may be shown in FIG. 1. The base station may include a baseband unit 101, a radio frequency unit 102, an antenna system 103, and the like. In addition, the base station may further include other components that are not shown in FIG. 1, such as a power supply and a Global Positioning System (GPS).

The baseband unit 101 may be a baseband unit (BBU), and the radio frequency unit 102 may be a remote radio unit (RRU). The antenna system 103 may include a phase shifter, a power splitter, and the like.

Figure 2:
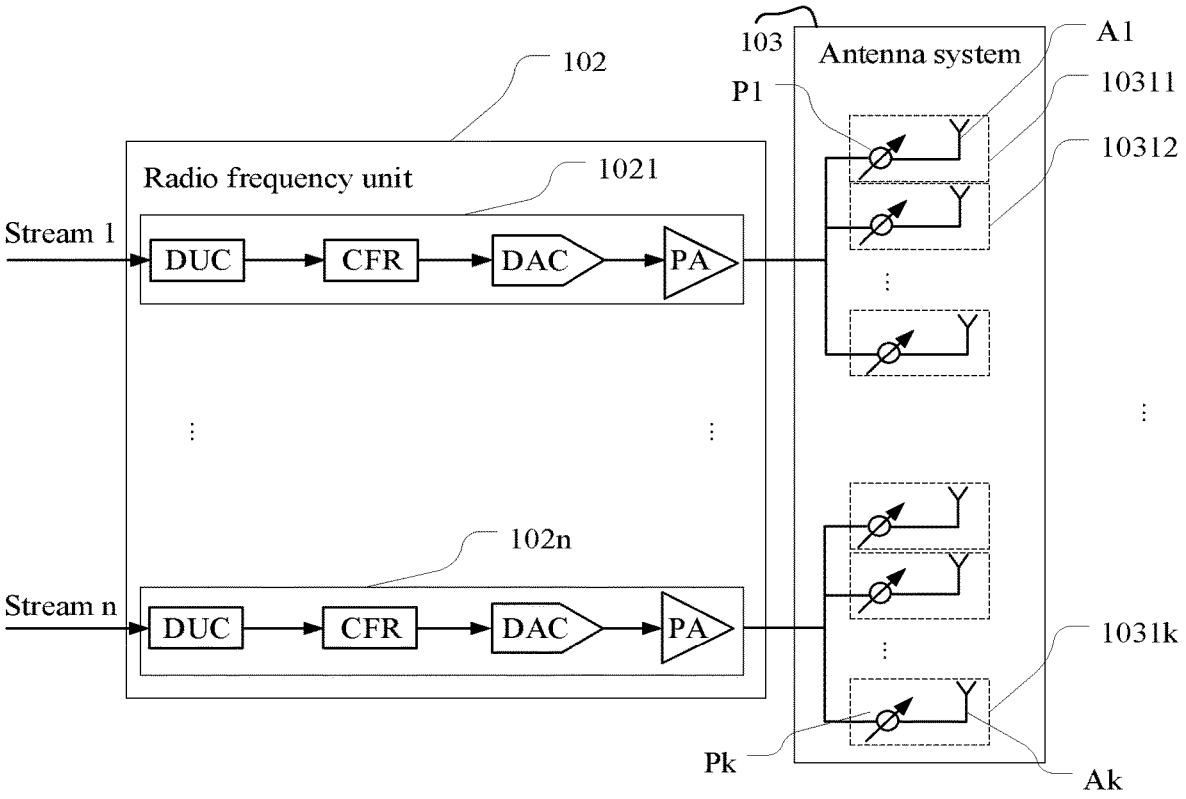
FIG. 2 is a schematic diagram of a structure to which a phase shifter is applied according to an embodiment of this application.

A connection relationship between the radio frequency unit 102 and the antenna system 103 is shown in FIG. 2. FIG. 2 may also be understood as an architectural diagram of DHBF. Still referring to FIG. 2, the radio frequency unit 102 may include at least one signal transceiver channel (1021, . . . , 102*n*), and each signal transceiver channel is used to process one radio frequency signal stream (stream). For example, in FIG. 2, a signal transceiver channel 1021 is used to process a stream 1, and a signal transceiver channel 102*n* is used to process a stream n.

As shown in FIG. 2, each signal transceiver channel may include a digital up converter (DUC), a crest factor reduction (CFR) apparatus, a digital-to-analog converter (DAC), and a power amplifier (PA). In addition, each signal transceiver channel may further include another function module in addition to the function modules shown in FIG. 2.

As shown in FIG. 2, the antenna system 103 may include at least one antenna unit (10311, 10312, . . . , 1031*k*), and each antenna unit may include at least one phase shifter (P1, . . . , Pk) and at least one antenna (A1, . . . , Ak).

The following uses the signal transceiver channel 1021 and an antenna unit 10311 in FIG. 2 as an example for description. An input end of the signal transceiver channel 1021 receives the stream1, an output end is connected to a phase shifter P1 in the antenna unit 10311, and the signal transceiver channel 1021 is connected to an antenna A1 using the phase shifter P1. A control signal of the phase shifter P1 is provided by the signal transceiver channel 1021, and a phase-shift state of the phase shifter is controlled using the control signal, to control phase distribution of an electromagnetic wave of the antenna A1.

In this application, the BBU first generates a switching trigger mark and beam information, the beam information may include a downtilt, and the downtilt is an angle of an antenna radiation signal. The RRU generates a control signal based on the beam information, the control signal is used to control a phase-shift state of a phase shifter, and a same transmission length is implemented in case of different phase-shift states of the phase shifter. Therefore, when the phase-shift state of the phase shifter is switched, transmission lengths corresponding to all phase-shift states are different such that after the phase-shift state of the phase shifter is switched, a transmission length of a radio frequency signal is changed, and a phase of the input radio frequency signal is changed, thereby implementing phase shift.

It may be understood that the RRU includes a drive module that generates the control signal, and generates the control signal using the drive module, to switch the phase-shift state of the phase shifter, thereby implementing phase shift.

The phase shifter in this application may be a switched-line phase shifter, a loaded-line phase shifter, or the like.

Figure 3:
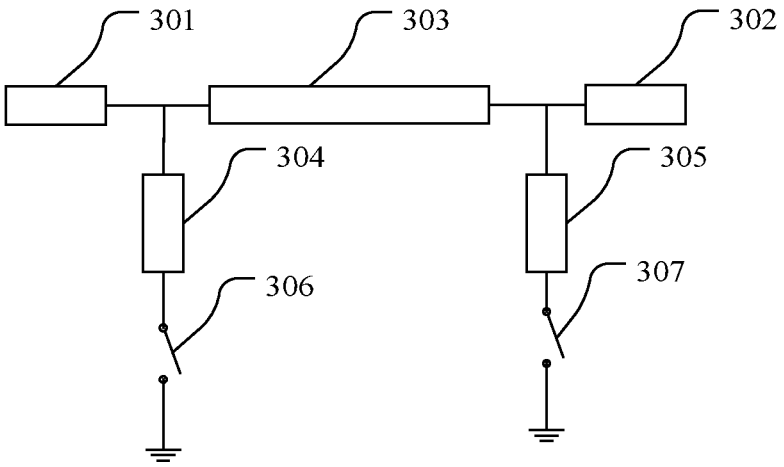
FIG. 3 is a specific schematic diagram of a loaded-line phase shifter.

The following uses a loaded-line phase shifter as an example for description. As shown in FIG. 3, the loaded-line phase shifter includes a radio frequency input transmission line 301, a radio frequency output transmission line 302, a primary transmission line 303, and two single-pole single-throw switches (a single-pole single-throw switch 306 and a single-pole single-throw switch 307). One terminal of the single-pole single-throw switch 306 is connected between the radio frequency input transmission line 301 and the primary channel transmission line 303 using a transmission line 304, and the other terminal is grounded. One terminal of the single-pole single-throw switch 307 is connected between the radio frequency output transmission line 302 and the primary channel transmission line 303 using a transmission line 305, and the other terminal is grounded. A length of the primary channel transmission line 303 in the loaded-line phase shifter is fixed to a ¼ wavelength of a radio frequency signal input from the radio frequency input 301. Therefore, when a wavelength of the input radio frequency signal is relatively large, the length of the primary channel transmission line 303 is relatively large, thereby increasing a size of the phase shifter.

In addition, the loaded-line phase shifter includes three transmission lines, and an electrical angle and a loaded capacitor vary with a frequency such that a phase shift amount and a standing wave ratio also vary with the frequency. Therefore, an operating bandwidth of the loaded-line phase shifter is relatively narrow, and the bandwidth of the loaded-line phase shifter is decreased as the phase shift amount is increased. For example, if a phase shift error is required to be less than 2 degrees and an input standing wave ratio is required to be less than 1.2, a relative bandwidth of a 22.5-degree loaded-line phase shifter is 43% through calculation. A relative bandwidth of a 45-degree loaded-line phase shifter is approximately 20%. Therefore, the bandwidth of the loaded-line phase shifter is decreased sharply as the phase shift amount is increased.

Figure 4A:
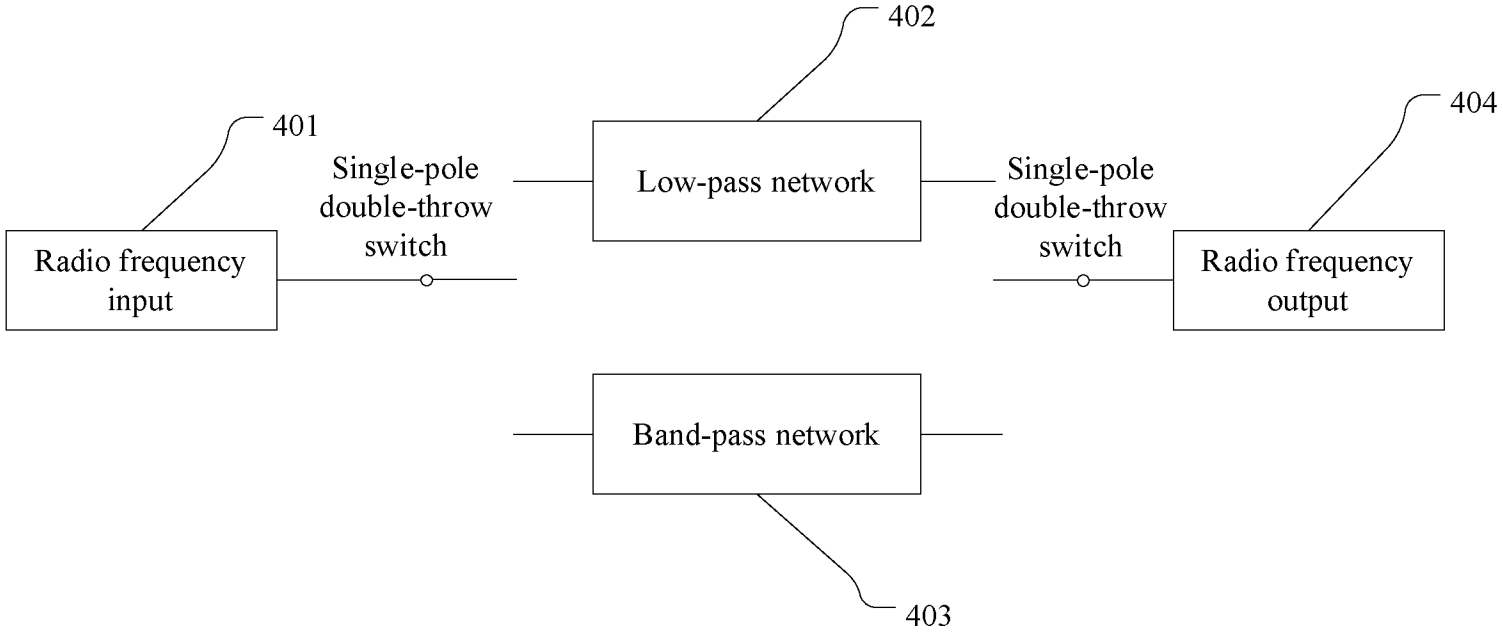
FIG. 4A is a schematic diagram of an embodiment of a switched-line phase shifter.
Figure 4B:
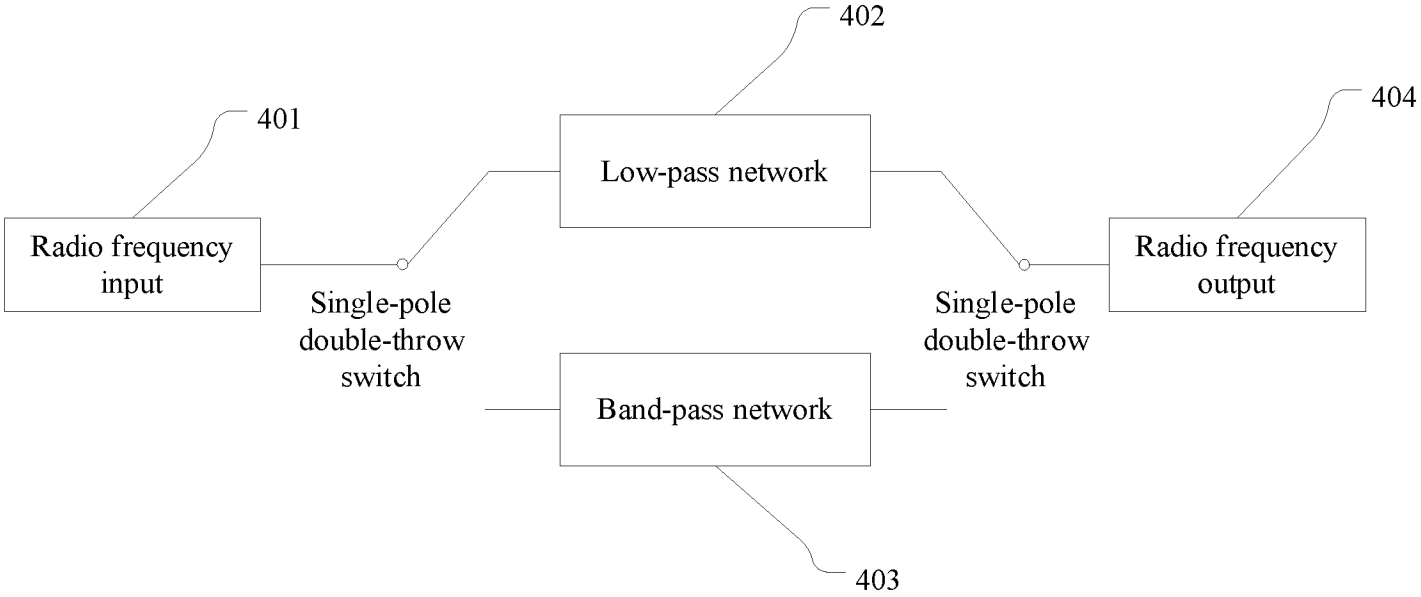
FIG. 4B is a schematic diagram of switching one state of a switched-line phase shifter.
Figure 4C:
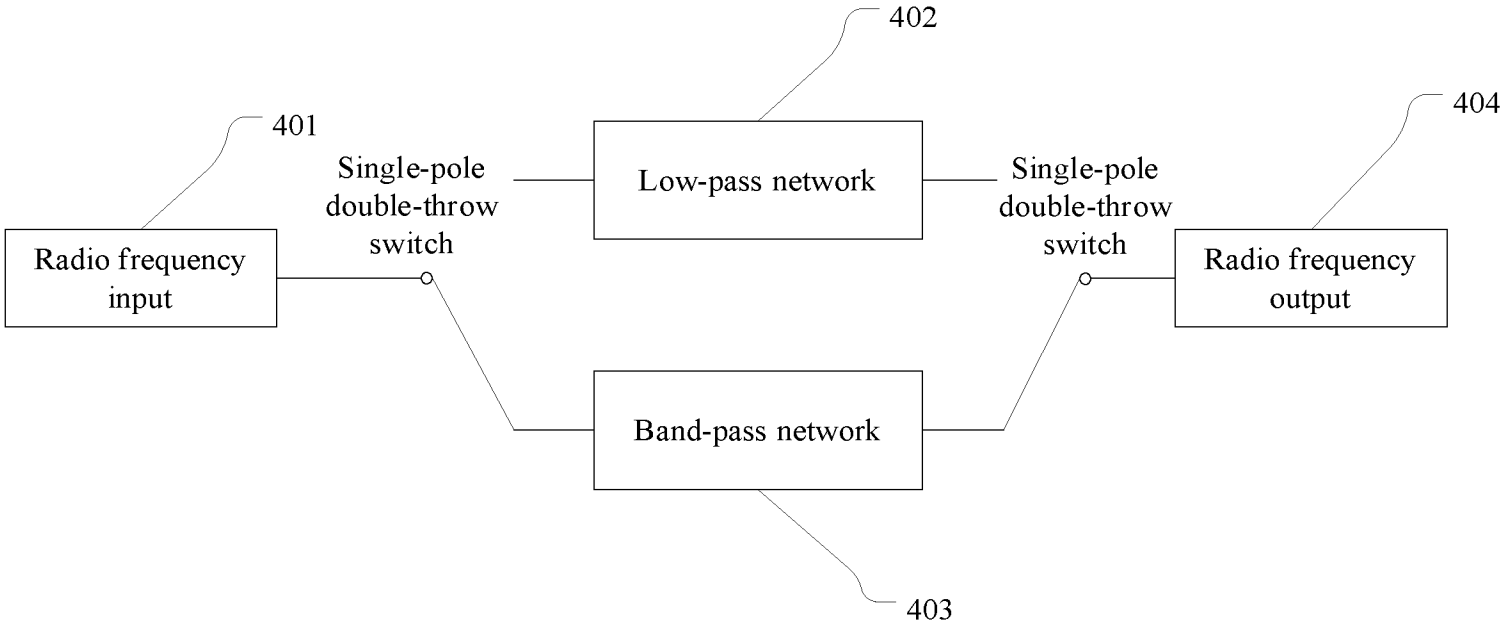
FIG. 4C is a schematic diagram of switching another state of a switched-line phase shifter.

FIG. 4A, FIG. 4B, and FIG. 4C are circuit diagrams of a switched-line phase shifter. As shown in FIG. 4A, the switched-line phase shifter may include a radio frequency input transmission line 401, a low-pass network 402, a band-pass network 403, and a radio frequency output transmission line 404. The radio frequency input transmission line 401 is radio frequency input in FIG. 4, and the radio frequency output transmission line 404 is radio frequency output in FIG. 4.

The low-pass network 402 and the band-pass network 403 are connected in parallel between the radio frequency input transmission line 401 and the radio frequency output transmission line 404, and the low-pass network 402 and the band-pass network 403 are not connected at a same time, that is, only one network can be connected on at one moment. The low-pass network 402 or the band-pass network 403 can be connected between the radio frequency input transmission line 401 and the radio frequency output transmission line 404 by switching two single-pole double-throw switches.

For example, the low-pass network may include a transmission line and a capacitor connected in series. The band-pass network may include a capacitor and an inductor that are connected in parallel. Alternatively, the low-pass network may include a transmission line and an inductor connected in series, and the band-pass network may include a capacitor and an inductor that are connected in series. A length of the transmission line is obtained through calculation based on a phase shift amount. Usually, a larger phase shift amount indicates a larger length of the transmission line. As a result, a volume of the phase shifter is increased with the phase shift amount. It should be noted that the existing solution further includes a plurality of implementations of the low-pass network and the band-pass network, and working principles of the low-pass network and the band-pass network are similar to those in the foregoing example. This is only an example herein, and examples are not provided one by one for description.

As shown in FIG. 4B, when the two single-pole double-throw switches are switched to the low-pass network at a same time, the phase shifter has a low-pass characteristic. As shown in FIG. 4C, when the single-pole double-throw switches are switched to the band-pass network at a same time, the phase shifter has a band-pass characteristic. Phase shift is implemented on a radio frequency signal through switching between the low-pass network and the band-pass network.

When the switched-line phase shifter operates, only a part of networks operate, and another part of networks are not connected to the radio frequency input transmission line 401 and the radio frequency output transmission line 404, cannot transmit a signal, and do no operate. Therefore, the switched-line phase shifter shown in FIG. 4A to FIG. 4C has relatively low utilization of an internal component and a relatively large size.

To reduce the size of the phase shifter and further reduce sizes of an antenna system and a base station, in this application, a state of the phase shifter is switched such that a component in the phase shifter can be effectively used in phase shift in both a low-pass state and a band-pass state/a high-pass state, and an equivalent electrical length of the phase shifter is increased or an equivalent electrical length of the phase shifter is reduced, thereby reducing the size of the phase shifter.

Figure 5A:
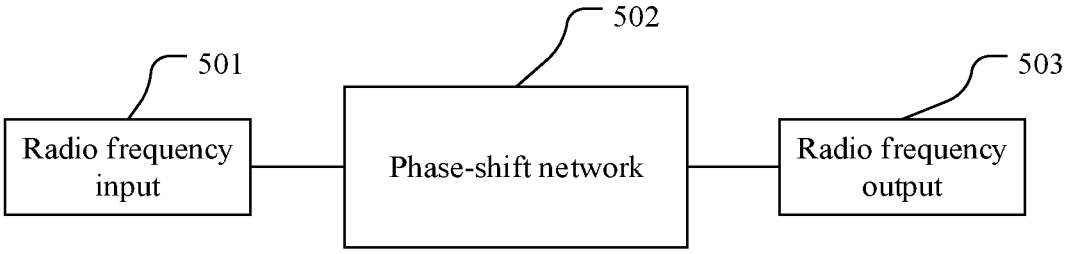
FIG. 5A is a schematic diagram of an embodiment of a phase shifter according to an embodiment of this application.

As shown in FIG. 5A, the phase shifter provided in this application may include a radio frequency input transmission line 501, a phase-shift network 502, and a radio frequency output transmission line 503. The radio frequency input transmission line 501 is radio frequency input in FIG. 5, and the radio frequency output transmission line 503 is radio frequency output in FIG. 5.

Figure 5B:
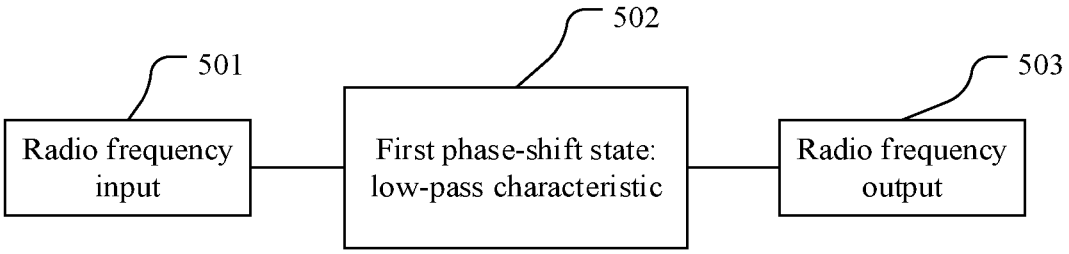
FIG. 5B is a schematic diagram of switching one state of a phase shifter according to an embodiment of this application.
Figure 5C:
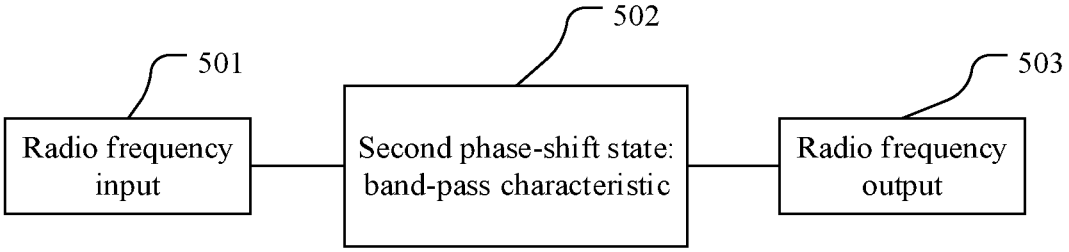
FIG. 5C is a schematic diagram of switching another state of a phase shifter according to an embodiment of this application.

A control signal sent by a BBU is input into the phase shifter, and a phase-shift state is switched using the control signal. As shown in FIG. 5B, when the phase shifter is in a first phase-shift state, the phase shifter has a low-pass characteristic. As shown in FIG. 5C, when the phase shifter is in a second phase-shift state, the phase shifter has a band-pass characteristic or a high-pass characteristic. The low-pass characteristic means that the phase shifter passes through only a low-frequency signal. The band-pass characteristic means that the phase shifter passes through only a signal in a fixed frequency band. Different delays may be obtained by switching the phase-shift state of the phase shifter, and phase shift is performed on an input radio frequency signal.

Further, the phase-shift network may include a transmission line and a switch component. Different characteristics such as an inductor characteristic or a capacitor characteristic are presented in the phase-shift network by switching a state of the switch component. When the inductor characteristic or the capacitor characteristic is presented in the phase-shift network, the phase shifter has different equivalent electrical lengths. It may be understood that, when a state of the phase-shift network is switched, a transmission electrical length of a radio frequency signal input from the radio frequency input transmission line is switched such that when phase shift is performed on the radio frequency signal input from the radio frequency input transmission line, there is no need to respectively implement the band-pass characteristic/the high-pass characteristic and the low-pass characteristic using two different circuits, and phase shift can be implemented only by changing the state of the phase shifter, thereby effectively improving utilization of each component in the phase shifter and reducing a volume of the phase shifter.

Further, the phase shifter provided in this application may include a radio frequency input transmission line, a radio frequency output transmission line, and at least two branches connected in parallel between the radio frequency input transmission line and the radio frequency output transmission line. Each of the at least two branches includes at least one switch component, and the at least two branches are connected in parallel between the radio frequency input transmission line and the radio frequency output transmission line. Two branches are used as an example, and include a first branch and a second branch. The first branch and the second branch are separately connected in parallel between the radio frequency input transmission line and the radio frequency output transmission line. At least one first switch component and at least one first transmission line are connected in series on the first branch. The second branch includes at least two transmission lines. For example, the second branch may include at least a second transmission line and a third transmission line. One terminal of the second transmission line is connected to the radio frequency input transmission line, and the other terminal of the second transmission line is connected to one terminal of the third transmission line. The other terminal of the third transmission line is connected to the radio frequency output transmission line, and the second transmission line and the third transmission line form a connection node. One terminal of each second switch component is connected to the connection node, and the other terminal is connected to a corresponding grounding component. When both the first switch component and the second switch component in the phase shifter are in a turning-on state, the second branch is equivalent to a shunt inductor of the first branch. When both the first switch component and the second switch component in the phase shifter are in a turning-off state, the first branch is equivalent to a shunt capacitor of the second branch. The grounding component is configured to transmit, to a grounding terminal, a radio frequency signal that passes through the second switch component.

Figure 6:
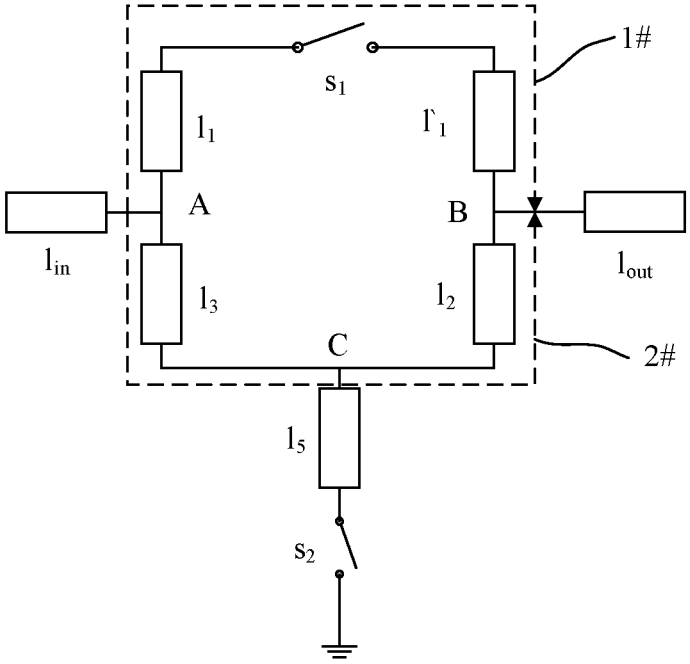
FIG. 6 is a schematic diagram of an embodiment of a phase shifter according to an embodiment of this application.

The following uses a specific structure to describe the phase shifter provided in this application. FIG. 6 is a schematic diagram of an embodiment of a phase shifter provided in this application.

The phase shifter provided in this application may include a radio frequency input transmission line $l_{in}$, a radio frequency output transmission line $l_{out}$, a transmission line $l_1$, a transmission line $l'_1$, a transmission line $l_2$, a transmission line $l_3$, a transmission line $l_5$, a switch $S_1$, and a switch $S_2$. The switch $S_1$ is a first switch component, and the switch $S_2$ is a second switch component. The transmission line $l_1$, the transmission line $l'_1$ and the switch $S_1$ are connected in series to form a first branch, namely, 1 #shown in FIG. 6. The transmission line $l_2$ and the transmission line $l_3$ are connected in series and then are connected to the switch $S_2$ to form a second branch, namely, 2 #shown in FIG. 6. The switch $S_1$ is connected in series on the first branch. One terminal of the switch $S_1$ is connected to the transmission line $l_1$, and the other terminal is connected to the transmission line $l'_1$. The second branch further includes the switch $S_2$ connected in parallel with the second branch. One terminal of the switch $S_2$ is connected to a connection node of the transmission line $l_2$ and the transmission line 3 using the transmission line $l_5$, and the other terminal of the switch $S_2$ is connected to a grounding component. The first branch and the second branch are connected in parallel between the radio frequency input transmission line $l_{in}$ and the radio frequency output transmission line $l_{out}$. A connection node of the transmission line $l_1$, the transmission line $l_3$, and the radio frequency input transmission line $l_{in}$ is marked as a point A. A connection node of the transmission line $l'_1$, the transmission line $l_2$, and the radio frequency output transmission line $l_{out}$ is marked as a point B. A connection node of the transmission line $l_2$, the transmission line $l_3$, and the transmission line $l_5$ is marked as a point C.

The transmission line $l_1$ and the transmission line $l'_1$ are respectively two first transmission lines. The transmission line $l_2$ is a second transmission line. The transmission line $l_3$ is a third transmission line. The transmission line $l_5$ is a fifth transmission line.

A length of the transmission line $l_5$ is less than a ¼ wavelength of a radio frequency signal input from the radio frequency input transmission line $l_{in}$, and a sum of lengths of the transmission line $l_1$ and the transmission line $l'_1$, namely, a length of the first branch, is also less than a ¼ wavelength of the radio frequency signal input from the radio frequency input transmission line $l_{in}$. In addition, the lengths of the transmission line $l_1$ and the transmission line $l'_1$ may be different.

Optionally, lengths of the transmission line $l_1$, the transmission line $l'_1$, the transmission line $l_2$, the transmission line $l_3$, and the transmission line $l_5$ are all less than or equal to a ⅛ wavelength of the radio frequency signal input from the radio frequency input transmission line $l_{in}$.

Figure 7A:
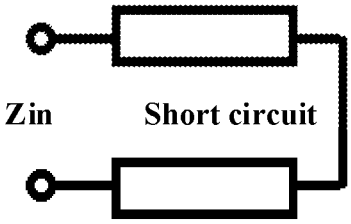
FIG. 7A is a schematic diagram of a transmission line in a short-circuit state according to an embodiment of this application.
Figure 7B:
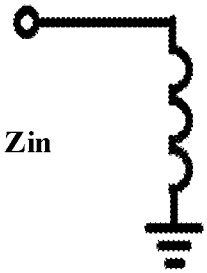
FIG. 7B is an equivalent schematic diagram of a transmission line in a short-circuit state according to an embodiment of this application.

When both the switch $S_1$ and the switch $S_2$ are in a turning-on state, that is, when two terminals of each first switch component and two terminals of each second switch component are turned on, both the first branch and the second branch are connected. For example, a transmission line with a short-circuit terminal may be shown in FIG. 7A. As shown in FIG. 7B, when a length of the short-circuit transmission line is less than a ¼ wavelength, the short-circuit transmission line may be equivalent to an inductor. Therefore, in this implementation of this application, when both the switch $S_1$ and the switch $S_2$ are in the turning-on state, one terminal of the transmission line $l_5$ is grounded, the transmission line $l_5$ is short-circuited, and the length of the transmission line $l_5$ is less than a ¼ wavelength of the radio frequency signal input from the radio frequency input transmission line $l_{in}$. Therefore, the transmission line $l_5$ may be equivalent to an inductor. Further, when both the switch $S_1$ and the switch $S_2$ are in the turning-on state, an equivalent circuit corresponding to FIG. 6 may be shown in FIG. 8A. The switch $S_1$ is turned on, the transmission line $l_1$ and the transmission line $l'_1$ are connected, the transmission line $l_1$ and the transmission line $l'_1$ on the first branch are short-circuited, and the length of the first branch is less than a ¼ wavelength of the radio frequency signal input from the radio frequency input transmission line $l_{in}$. Therefore, the transmission line $l_1$ and the transmission line $l'_1$ may be equivalent to an inductor $L_{12}$. The transmission line $l_5$ is equivalent to an inductor $L_5$, is connected in parallel with the first branch using the transmission line $l_2$ and the transmission line $l_3$, and is equivalent to a shunt inductor of the first branch. In this case, most input radio frequency signals are transmitted using the first branch. The circuit shown in FIG. 8A may be further equivalent to a circuit shown in FIG. 8B. One terminal of an inductor $L_5$ is connected in parallel with the first branch at the point A using the transmission line $l_3$, and the other terminal is grounded. One terminal of an inductor $L_5$ is connected in parallel with the first branch at the point B using the transmission line $l_2$, and the other terminal is grounded. Because a delay is reduced due to inductor loading, when both the switch $S_1$ and the switch $S_2$ are in the turning-on state, a delay of the first branch may be understood as D1, that is, the delay includes only transmission delays of the transmission line $l_1$ and the transmission line $l'_1$. An actual delay of transmitting the radio frequency signal, input from the transmission line $l_{in}$, from the point A to the point B may be understood as D3, where D3 is less than D1. When a radio frequency signal is input, a phase of the radio frequency signal is advanced after the radio frequency signal is transmitted using the first branch. In this case, the phase shifter has a band-pass characteristic or a high-pass characteristic, and allows a signal in a fixed frequency band to pass through.

Figure 9A:
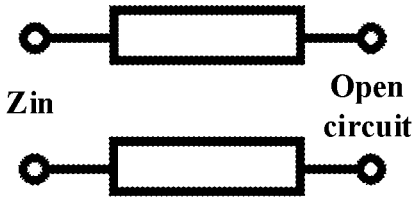
FIG. 9A is a schematic diagram of a transmission line in an open-circuit state according to an embodiment of this application.
Figure 9B:
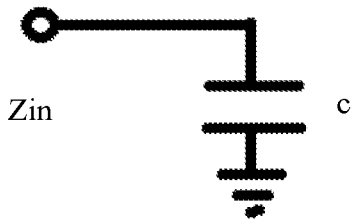
FIG. 9B is an equivalent schematic diagram of a transmission line in an open-circuit state according to an embodiment of this application.

When both the switch $S_1$ and the switch $S_2$ are in a turning-off state, that is, when two terminals of each first switch component and two terminals of each second switch component are turned off, the first branch is open-circuited, and the second branch is connected. For example, a transmission line with an open-circuit terminal may be shown in FIG. 9A. As shown in FIG. 9B, when a length of the open-circuit transmission line is less than a ¼ wavelength, the open-circuit transmission line may be equivalent to a capacitor. In this implementation of this application, the transmission line $l_1$, the transmission line $l'_1$, and the transmission line $l_5$ are all open-circuited, and the lengths of the three transmission lines are all less than or equal to a ⅛ wavelength of the radio frequency signal input from the radio frequency input transmission line $l_{in}$. Therefore, the transmission line $l_1$, the transmission line $l'_1$, and the transmission line $l_5$ each may be equivalent to a capacitor. Further, when both the switch $S_1$ and the switch $S_2$ are in the turning-off state, an equivalent circuit corresponding to FIG. 6 may be shown in FIG. 10. The transmission line $l_1$ may be equivalent to a capacitor $C_1$ shown in FIG. 10, and is connected in parallel with the second branch at the point A. The transmission line $l_5$ may be equivalent to a capacitor $C_5$ shown in FIG. 10, and is connected in parallel with the second branch at the point C. The transmission line $l'_1$ may be equivalent to a capacitor $C_2$ shown in FIG. 10, and is connected in parallel with the second branch at the point B. In addition, the capacitors $C_1$, $C_2$, and $C_5$ each are connected to a grounding terminal using a grounding component. In this case, the first branch presents a low-pass characteristic. The transmission line $l_1$, the transmission line $l'_1$, and the transmission line $l_5$ respectively implement capacitor loading on the second branch at the point A, the point B, and the point C such that a delay of the phase shifter is increased. In this case, an equivalent electrical length of the phase shifter is greater than a physical length of the second branch. When both the switch $S_1$ and the switch $S_2$ are in the turning-off state, most signals are transmitted using the second branch. Therefore, the second branch circuit is used as a primary transmission line, and a delay of the second branch may be understood as D2, that is, the delay includes only transmission delays of the transmission line $l_2$ and the transmission line $l_3$. An actual delay of transmitting the radio frequency signal, input from the transmission line $l_{in}$, from the point A to the point B may be understood as D3', where D3' is greater than D2. When a radio frequency signal is input, because the first branch presents a capacitor characteristic, capacitor loading is implemented on the second branch, and a phase is lagged. In this case, the phase shifter has the low-pass characteristic, and allows a signal whose frequency is less than a threshold to pass through.

When the switch $S_1$ and the switch $S_2$ are switched between the turning-on state and the turning-off state, an actual switching delay difference is a delay difference between switching from turning off to turning on of all first switch components and second switch components, namely, a transmission delay difference that is of the radio frequency signal input from the radio frequency input transmission line $l_{in}$ and that is between turning off of all the first switch components and second switch components and turning on of all the first switch components and second switch components. For example, it may be understood that the switching delay difference is D4, where D4=D3'−D3, an ideal delay difference between the first branch and the second branch is D5, where D5=D2−D1, and the switching delay difference D4 is greater than the ideal delay difference D5. Therefore, phase shift can be implemented on the input radio frequency signal by switching the switch $S_1$ and the switch $S_2$ between the turning-on state and the turning-off state, that is, phase shift can be implemented on the phase shifter using the switching delay difference. In addition, the actual delay difference existing when states of the first switch component and the second switch component are switched is greater than the ideal delay difference between the first branch and the second branch. This may be understood as follows. A larger switching delay difference can be implemented using a shorter transmission line, to implement a larger phase shift amount using a phase shifter of a smaller size.

Further, when a switch in the phase shifter is switched, for example, a state in which all switches are turned on is switched to a state in which all the switches are turned off. When the turning-on state is switched to the turning-off state, transmission of the radio frequency signal input from the radio frequency input transmission line is switched from the first branch to the second branch such that the phase of the radio frequency signal input from the radio frequency input transmission line is lagged. When the turning-off state is switched to the turning-on state, transmission of the radio frequency signal input from the radio frequency input transmission line is switched from the second branch to the first branch such that the phase of the radio frequency signal input from the radio frequency input transmission line is advanced. Therefore, the first switch component and the second switch component in the phase shifter provided in this implementation of this application are switched between the turning-on state and the turning-off state such that a branch in a phase-shift network can have different characteristics, to implement capacitor loading or inductor loading, and increase or decrease the equivalent electrical length of the phase shifter. Furthermore, when the first branch is equivalent to capacitor loading of the second branch, capacitor loading may be understood as increasing a transmission length of the radio frequency signal using the second branch such that the equivalent electrical length of the phase shifter is greater than a physical length of a transmission line on the second branch. When the second branch is equivalent to inductor loading of the first branch, inductor loading may be understood as reducing a transmission length of the radio frequency signal that passes through the first branch. In this case, the equivalent electrical length of the phase shifter is less than a physical length of the first branch. Therefore, it may be understood that the first switch component and the second switch component in the phase shifter are switched such that because delays of all branches are different, when a switch is switched, a delay difference of the input radio frequency signal is generated between all the branches, and phase shift is implemented using a switching delay and the delay difference between the branches.

Therefore, the equivalent electrical length of the phase shifter provided in this application may be greater than a physical length. Compared with an existing solution, a larger equivalent electrical length can be implemented using a transmission line of a same length, or it may be understood that the phase shifter provided in this application may implement a larger equivalent electrical length using a shorter transmission line, thereby implementing a larger phase shift amount. In this way, a length of a branch can be reduced, and a physical size of the phase shifter can be reduced. Therefore, the phase shifter provided in this application may implement a same phase shift amount as a phase shifter in the existing solution using a smaller size, or implement a larger phase shift amount than a conventional phase shifter using a same size.

A length of a transmission line in this application is related to a phase shift amount, impedance of a transmission line, and a characteristic of a switch. Therefore, when the length of the transmission line is calculated, calculation may be performed with reference to a frequency band of an input radio frequency signal, the impedance of the transmission line, the characteristic of the switch, and the like.

In an optional implementation, an ideal first switch component and an ideal second switch component are used as an example, and a formula for calculating the length of the transmission line may be as follows:

$$\Delta\theta = \left\{\theta_1 + \theta_1' + \tan^1\left[-\frac{Z_C}{2} * \frac{Z_3 - 2Z_5\tan\theta_5\tan\theta_3}{Z_3(2Z_5\tan\theta_5 + Z_3\tan\theta_3)}\right] + \tan^{-1}\left[-\frac{Z_C}{2} * \frac{Z_2 - 2Z_5\tan\theta_5\tan\theta_2}{Z_2(2Z_5\tan\theta_5 + Z_2\tan\theta_2)}\right]\right\} - \left\{\theta_2 + \theta_3 + \tan^{-1}\left(-\frac{Z_C\tan\theta_1}{2Z_1')}\right) + \tan^{-1}\left(-\frac{Z_C\tan\theta_5\tan\theta_1'}{2Z_1')}\right) + \tan^{-1}\left(-\frac{Z_C\tan\theta_5\tan\theta_5}{2Z_5)}\right)\right\},$$

where $\Delta\theta$ is the phase shift amount of the phase shifter, $\theta_1$, $\theta_1'$, $\theta_2$, $\theta_3$, and $\theta_5$ are respectively transmission phases of the transmission lines $l_1$, $l'_1$, $l_2$, $l_3$, and $l_5$, $Z_1$, $Z_1'$, $Z_2$, $Z_3$, and $Z_5$ are respectively characteristic impedance of the transmission lines $l_1$, $l'_1$, $l_2$, $l_3$, and $l_5$, $Z_C$ is system characteristic impedance, and $Z_C$ is usually a preset value, for example, $Z_C$ is usually set to 50Ω.

Therefore, after determining parameters such as the phase shift amount of the phase shifter and the impedance of the transmission line, the lengths of the transmission lines $l_1$, $l'_1$, $l_2$, $l_3$, and $l_5$ may be calculated according to the foregoing formula. The phase shift amount $\Delta\theta$ of the phase shifter may be calculated based on a phase shift requirement in an actual application scenario. The transmission phase of the transmission line is related to a frequency of the radio frequency signal, the length of the transmission line, and the characteristic impedance of the transmission line.

In an optional implementation, in this embodiment of this application, grounding may be implemented in a plurality of other manners in addition to the grounding component. The second switch component is used as an example. One terminal of the second switch component may be directly grounded, or one terminal of the second switch component may be connected to one terminal of a capacitor, and the other terminal of the capacitor is directly grounded, or one terminal of the second switch component may be connected to one terminal of an open-circuit transmission line of a (¼+n*½) wavelength, and the other terminal of the open-circuit transmission line of a (¼+n*½) wavelength is open-circuited, or one terminal of the second switch component may be connected to a short-circuit transmission line of an n*½ wavelength, and the other terminal of the short-circuit transmission line of an n*½ wavelength is short-circuited, to implement grounding, where n is a positive integer, and may be further adjusted based on an actual requirement.

In another implementation of this embodiment of this application, when the first switch component and/or the second switch component meet a set condition, the physical length of the transmission line $l_1$, the transmission line $l'_1$, or the transmission line $l_5$ may be 0. The set condition may be that impedance of the first switch component and/or the second switch component meets a first threshold, or one parasitic parameter of the first switch component meets a second threshold, or the like. Values of the first threshold and the second threshold may be adjusted based on an actual requirement. This is not limited herein.

When the lengths of the transmission line $l_1$ and the transmission line $l'_1$ are 0, it may be understood that the first branch includes only the first switch component. One switch $S_1$ is used as an example. One terminal of the switch $S_1$ is connected to the radio frequency input transmission line, and the other terminal is connected to the radio frequency output transmission line. For example, FIG. 11 is a schematic diagram of another embodiment of a phase shifter provided in this application.

Figure 11:
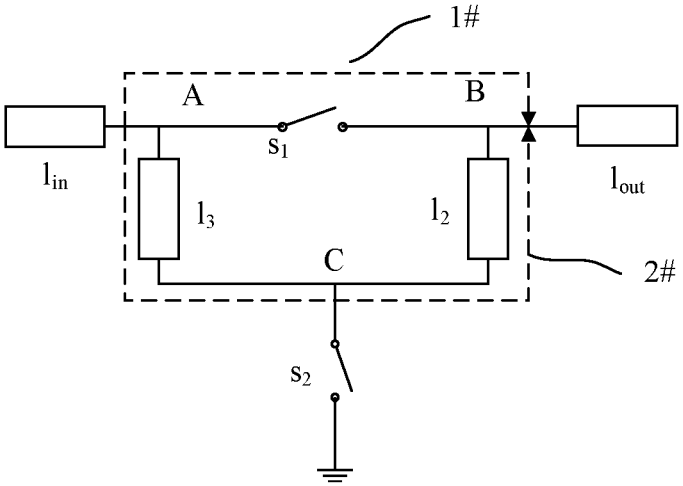
FIG. 11 is a schematic diagram of another embodiment of a phase shifter according to an embodiment of this application.

As shown in FIG. 11, the phase shifter includes a radio frequency input transmission line $l_{in}$, a radio frequency output transmission line $l_{out}$, a transmission line $l_2$, a transmission line $l_3$, a switch $S_1$, and a switch $S_2$. The switch $S_1$ is a first switch component, and the switch $S_2$ is a second switch component. A difference lies in that a physical length of the transmission line $l_1$, the transmission line $l'_1$, or a transmission line $l_5$ is 0. Other structures are similar to the structures in FIG. 6, and a working principle is also similar to the working principle corresponding to the phase shifter in FIG. 6. Details are not described herein again.

The switch $S_1$ is a first branch, namely, 1 #shown in FIG. 11, and the transmission line $l_2$ and the transmission line $l_3$ are connected in series to form a second branch, namely, 2 #shown in FIG. 11. The first branch includes only one switch $S_1$. One terminal of the switch $S_1$ is connected to one terminal of the radio frequency input transmission line $l_{in}$, and the other terminal of the switch $S_1$ is connected to one terminal of the radio frequency input transmission line $l_{out}$. One terminal of the switch $S_2$ may be connected to a grounding component, and the other terminal may be connected to a connection node C of the transmission line $l_2$ and the transmission line $l_3$.

Figure 8A:
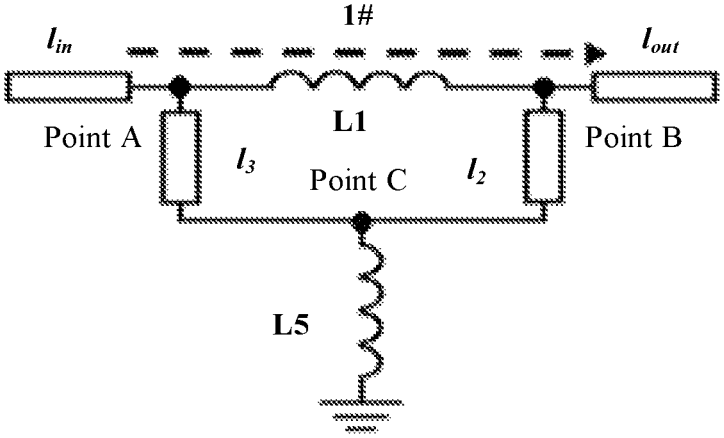
FIG. 8A is a schematic diagram of an equivalent circuit of a phase shifter when a switch is in a turning-on state according to an embodiment of this application.
Figure 8B:
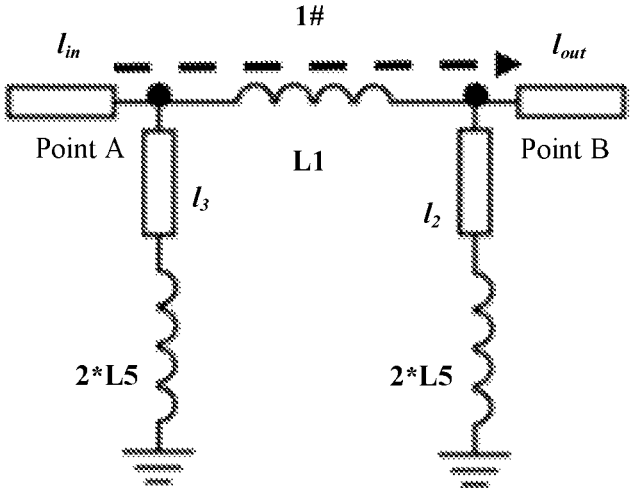
FIG. 8B is a schematic diagram of another equivalent circuit of a phase shifter when a switch is in a turning-on state according to an embodiment of this application.

When both the switch $S_1$ and the switch $S_2$ are in a turning-on state, the second branch is equivalent to a shunt inductor of the first branch, and an equivalent circuit is similar to those in FIG. 8A and FIG. 8B. Details are not described herein again.

When both the switch $S_1$ and the switch $S_2$ are in a turning-off state, after a radio frequency signal is input from the radio frequency input transmission line, the radio frequency signal passes through the second branch and is output from the radio frequency output transmission line. An equivalent circuit is similar to that in FIG. 10. Details are not described herein again. A difference lies in that the first branch is open-circuited, the first branch is not equivalent to an equivalent capacitor of the second branch, and the second branch includes only an equivalent capacitor $C_5$. Therefore, when both the switch $S_1$ and the switch $S_2$ are in the turning-off state, an equivalent electrical length of the phase shifter is increased using the equivalent capacitor of the second switch component.

When the turning-on state is switched to the turning-off state, transmission of the radio frequency signal input from the radio frequency input transmission line is switched from the first branch to the second branch such that a phase of the radio frequency signal input from the radio frequency input transmission line is lagged. When the turning-off state is switched to the turning-on state, transmission of the radio frequency signal input from the radio frequency input transmission line is switched from the second branch to the first branch such that a phase of the radio frequency signal input from the radio frequency input transmission line is advanced. When the second switch component is equivalent to a capacitor, capacitor loading may be understood as increasing a transmission length of the radio frequency signal such that the equivalent electrical length of the phase shifter is greater than a physical length of a transmission line on the second branch. When the second branch is equivalent to inductor loading of the first branch, inductor loading may be understood as reducing a transmission length of the radio frequency signal that passes through the first branch. In this case, the equivalent electrical length of the phase shifter is less than a physical length of the first branch. Therefore, it may be understood that the first switch component and the second switch component in the phase shifter are switched such that because delays of all branches are different, when a switch is switched, a delay difference of the input radio frequency signal is generated between all the branches, and phase shift is implemented using a switching delay and the delay difference between the branches.

On the basis of implementing phase shift, compared with the phase shifter in FIG. 6, the first branch includes only the first switch component. This reduces a quantity of transmission lines such that a size of the phase shifter can be further reduced. In addition, the physical length of the transmission line $l_5$ is also 0. It may be understood that the transmission line $l_5$ is not included, and one terminal of the switch is directly connected to the node C. Therefore, the size of the phase shifter can also be further reduced.

Figure 12:
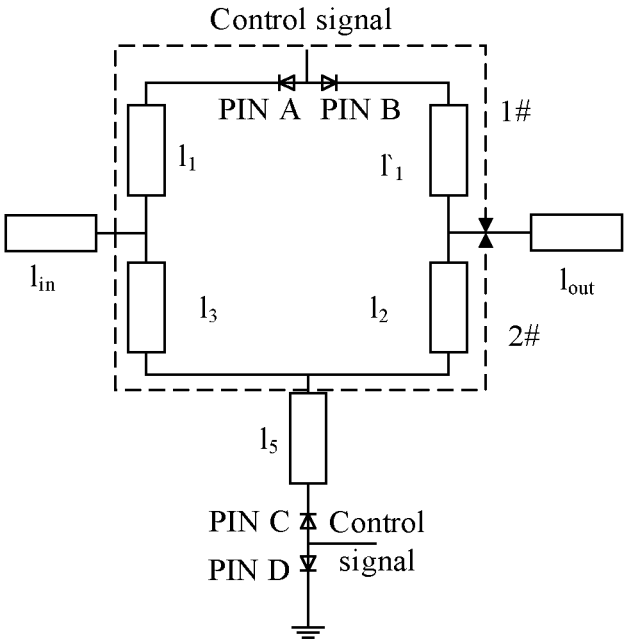
FIG. 12 is a schematic diagram of another embodiment of a phase shifter according to an embodiment of this application.

In an optional implementation, the switch in this implementation of this application may be a PIN diode, and as shown in FIG. 12, two PIN diodes may be used as one switch.

The switch $S_1$ and the switch $S_2$ each may be implemented using two PIN diodes. As shown in FIG. 12, the switch $S_1$ is implemented using diodes PIN A and PIN B, and terminals that have same polarity and that are of the PIN A and the PIN B are connected. The switch $S_2$ is implemented using diodes PIN C and PIN D, and terminals that have same polarity and that are of the PIN C and the PIN D are connected.

A control signal is required by each of the first switch component and the second switch component to control a state of the switch. Optionally, for control signals shown in FIG. 12, when the switch $S_1$ and the switch $S_2$ each include diodes with a totally same characteristic, the control signals are also the same. The control signal may be generated by an RRU based on beam information sent by a BBU. For example, the RRU may obtain the control signal through calculation based on a downtilt included in the beam information. In addition, the control signal is usually a direct current signal, a periodic square wave signal, or the like. Therefore, after the control signal is input into the switch, a direct current grounding component (not shown in the figure) may be further connected on the first branch or the second branch.

Figure 10:
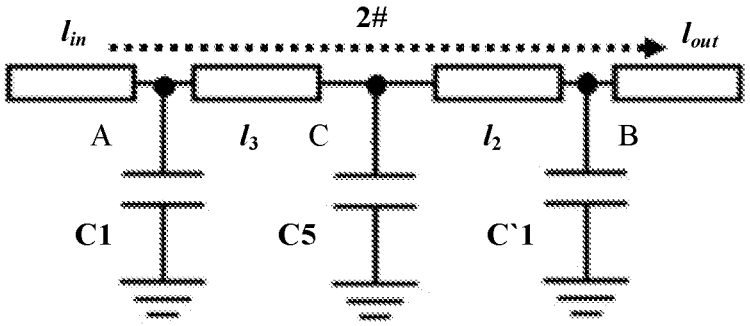
FIG. 10 is a schematic diagram of an equivalent circuit of a phase shifter when a switch is in a turning-off state according to an embodiment of this application.

A diagram of an equivalent circuit corresponding to FIG. 12 is similar to FIG. 8A, FIG. 8B, and FIG. 10. Details are not described herein again.

Figure 13A:
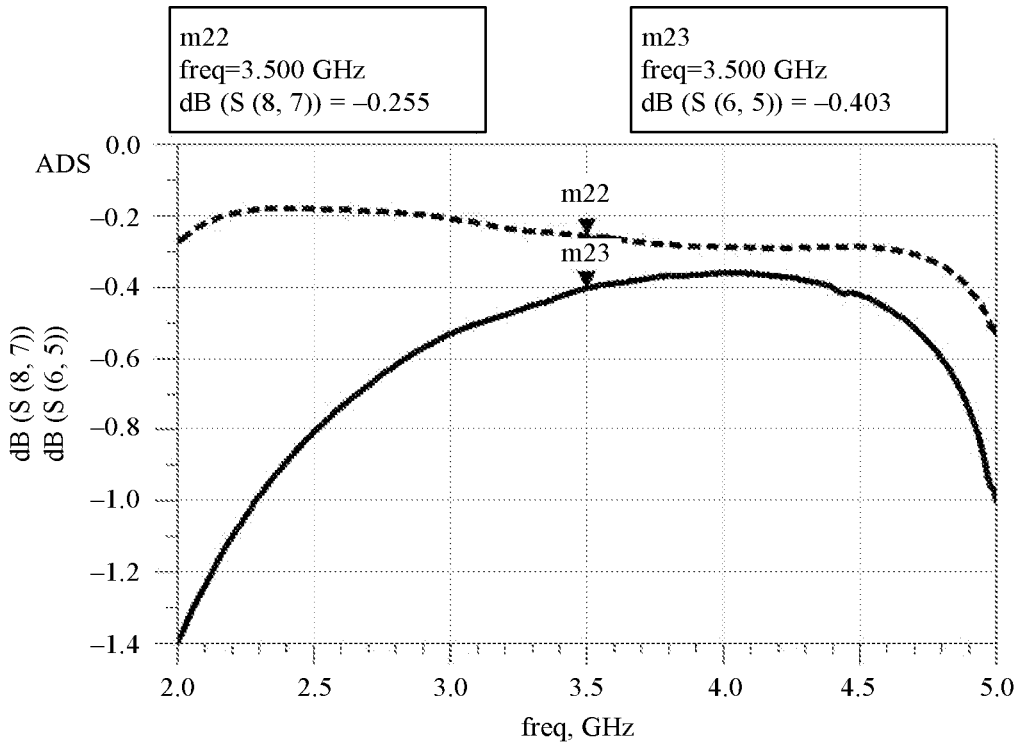
FIG. 13A is a schematic diagram of a correspondence between an insertion loss and a frequency of a phase shifter according to an embodiment of this application.
Figure 13B:
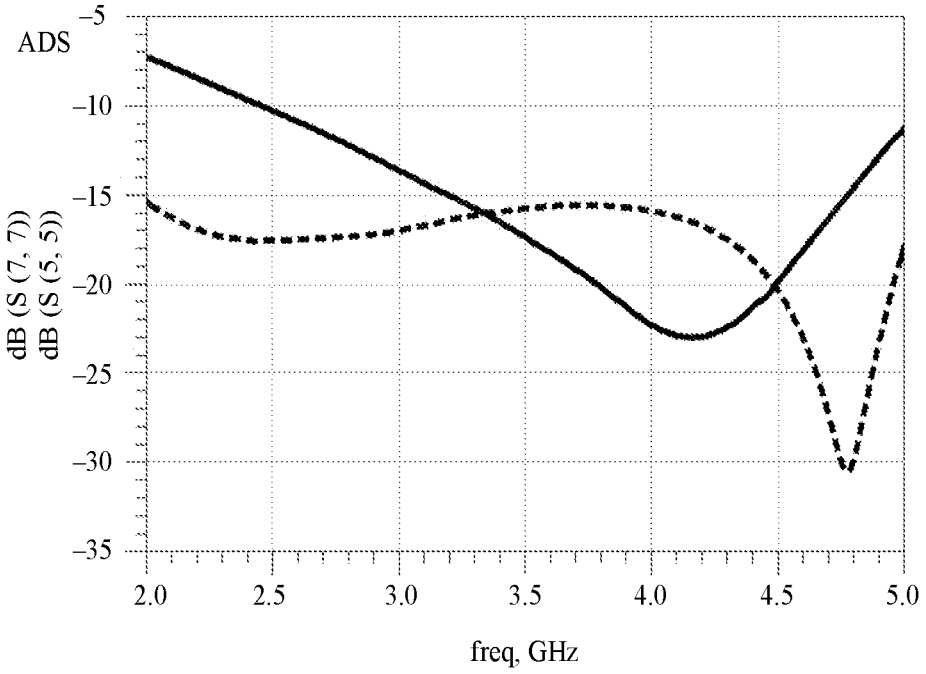
FIG. 13B is a schematic diagram of a correspondence between a return loss and a frequency of a phase shifter according to an embodiment of this application.
Figure 13C:
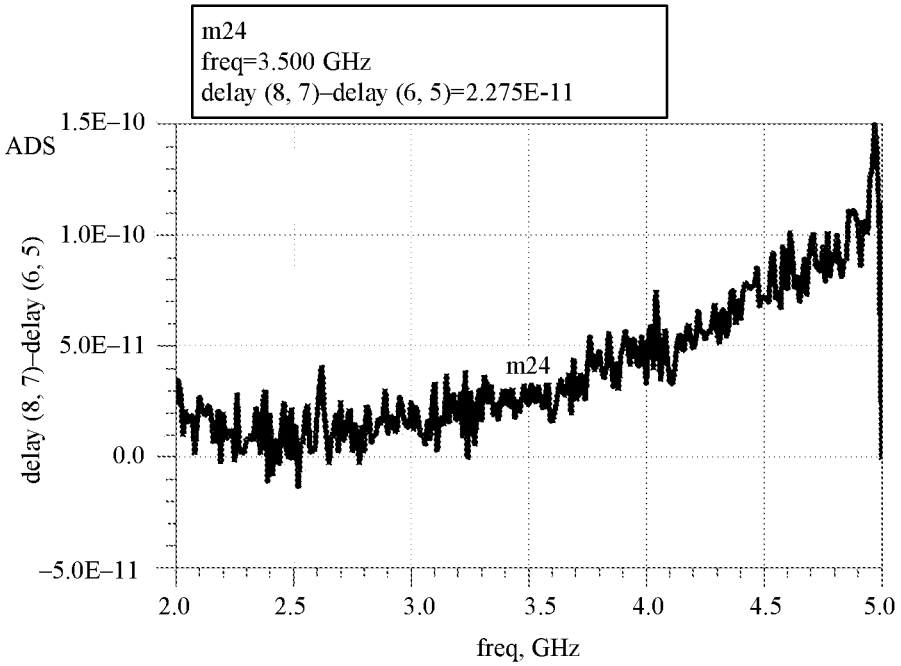
FIG. 13C is a schematic diagram of a correspondence between a delay difference and a frequency of a phase shifter according to an embodiment of this application.
Figure 13D:
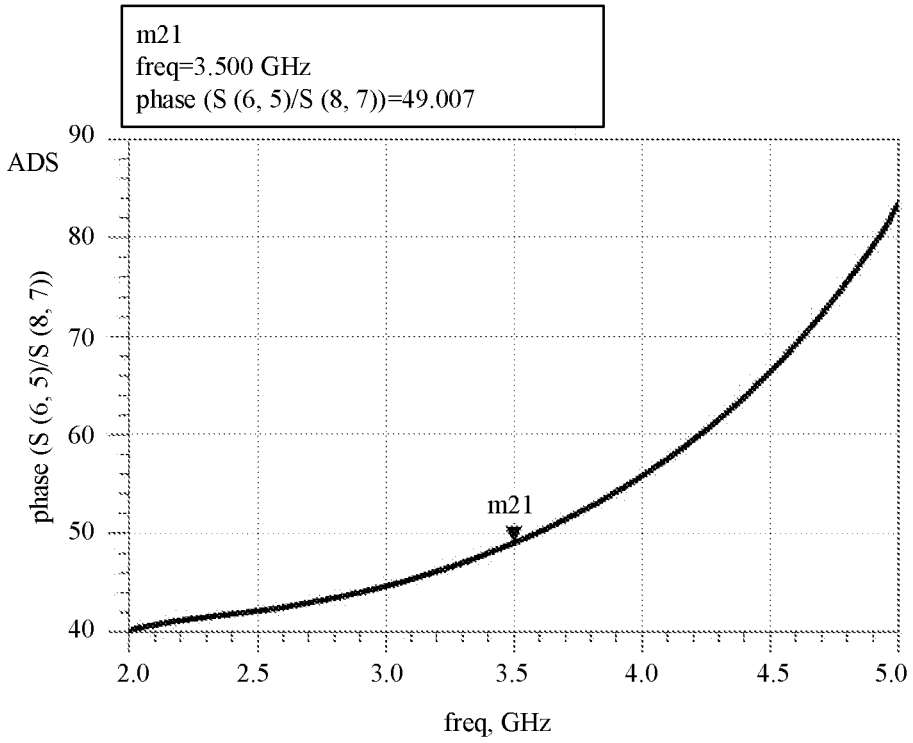
FIG. 13D is a schematic diagram of a correspondence between a phase shift amount and a frequency of a phase shifter according to an embodiment of this application.

Therefore, in this implementation of this application, a function of the switch may be implemented using the PIN diode, reactor loading is performed on a radio frequency transmission path in the phase shifter using an open-circuit capacitor and a short-circuit inductor of the PIN diode, and equivalent reactor that is of a transmission line and that exists when the PIN diode is in an open-circuit state or a short-circuit state. For example, a result of measuring the phase shifter may include the following. A relationship between an insertion loss and a frequency may be shown in FIG. 13A, a relationship between a return loss and a frequency is shown in FIG. 13B, a relationship between a delay difference and a frequency is shown in FIG. 13C, and a relationship between a phase shift amount and a frequency is shown in FIG. 13D. It may be learned from FIG. 13A to FIG. 13D that, in a 3.3 GHz to 4.7 GHz frequency band, the insertion loss is less than 0.5 decibel (dB), the return loss is less than −15 dB, the delay difference is 22.75 picoseconds (ps), and the phase shift amount is 49 degrees.

A length of each transmission line is calculated based on the impedance of the switch S1 and the switch S2, the impedance of the transmission line, the phase shift amount, and the like. A length of a specific transmission line is used as an example. The length of the transmission line $l_1$ is 31 mil, the length of the transmission line $l'_1$ is 31 mil, the length of the transmission line $l_2$ is 122 mil, the length of the transmission line $l_3$ is 122 mil, and the length of the transmission line $l_5$ is 128 mil. When a center frequency of the input radio frequency signal is a frequency of 3.5 GHz, the lengths of the transmission lines are respectively as follows. The length of the transmission line $l_1$ is a 0.014 wavelength, the length of the transmission line $l'_1$ is a 0.014 wavelength, the length of the transmission line $l_2$ is a 0.055 wavelength, the length of the transmission line $l_3$ is a 0.055 wavelength, and the length of the transmission line $l_5$ is a 0.058 wavelength. The lengths are far less than a ¼ wavelength. An overall size of the phase-shift circuit is 5.3 millimeters (mm)*8.8 mm=46.64 mm^2, and a length of an electrical size is 0.1 wavelength*0.16 wavelength.

In comparison, in a typical loaded-line phase shifter solution of the existing solution, a size of a phase shifter is 7.5 mm*15.4 mm=115.5 mm^2, and an electrical size is approximately 0.14 wavelength*0.28 wavelength. However, the size of the phase shifter provided in this application is 7.3 mm*11.3 mm=82.49 mm^2. Therefore, the size of the phase shifter provided in this application is far less than the size of the phase shifter in the existing solution.

Further, the following further compares and describes a typical loaded-line phase shifter and a typical switched-line phase shifter in the existing solution. For a structure of the loaded-line phase shifter, refer to the foregoing loaded-line phase shifter shown in FIG. 3. For the switched-line phase shifter, refer to the switched-line phase shifters shown in FIG. 4A to FIG. 4C.

In a scenario in which a center frequency is 3.5 GHz and phase shift amounts are different, a volume comparison between the phase shifter provided in this application and both the loaded-line phase shifter and the switched-line phase shifter may be shown in Table 1:

TABLE 1

| 3.5 GHz phase shifter | Conventional phase shifter | Phase shifter in this application | Miniaturization ratio |
|---|---|---|---|
| 22.5° phase-shift unit | 10 mm * 17 mm = 170 mm^2 | 7.7 mm * 12 mm = 92.4 mm^2 | 0.54 |
| 45° phase-shift unit | 7.5 mm * 15.4 mm = 115.5 mm^2 | 5.3 mm * 8.8 mm = 46.64 mm^2 | 0.4 |
| 90° phase-shift unit | 17.5 mm * 23.4 mm = 409.5 mm^2 | 7.3 mm * 11.3 mm = 82.49 mm^2 | 0.2 |
| 180° phase-shift unit | 20 mm * 33.3 mm = 666 mm^2 | 8.5 mm * 16.2 mm = 137.7 mm^2 | 0.21 |

For the conventional phase shifter in Table 1, the loaded-line phase shifter is used in case of the 22.5° phase-shift unit and the 45° phase-shift unit, and the switched-line phase shifter is used in case of the 90° phase-shift unit and the 180° phase-shift unit.

The 90° phase-shift unit is used as an example. A size of the 3.5 GHz phase shifter implemented based on the conventional switched-line phase shifter is 17.5 mm*23.4 mm=409.5 mm^2, and a size of the phase shifter implemented according to this application is 7.3 mm*11.3 mm=82.49 mm^2. Through comparison between the phase shifter provided in this application and the conventional switched-line phase shifter, a length of the phase shifter provided in this application is 0.42 times a length of the conventional switched-line phase shifter, a width of the phase shifter provided in this application is 0.48 times a width of the conventional switched-line phase shifter, and an area of the phase shifter provided in this application is 0.2 times an area of the conventional switched-line phase shifter.

Therefore, it can be learned from the foregoing comparison that, in a scenario in which frequencies are the same and phase shift amounts are the same, the length, the width, the area, and the like of the phase shifter provided in this application are far less than those of the phase shifter provided in the existing solution.

In addition, there is no specific relationship between a transmission line at each part of a circuit and an operating wavelength. A physical length of a transmission line is strongly correlated with the phase shift amount and switch characteristics of the first switch component and the second switch component, and a transmission line of a specific physical length is not required for specific use. In the conventional loaded-line phase shifter, a transmission line of a ¼ wavelength is used for impedance transformation. In the phase shifter shown in FIG. 12, the length of each transmission line is less than or equal to a ⅛ wavelength, and the phase shifter includes only a transmission line and a switch, there is no lumped component, and an insertion loss of a circuit is mainly limited by a loss of the switch. When the loss of the switch is relatively small, the circuit can implement a relatively small insertion loss.

In an optional implementation, the switch component in the phase shifter provided in this application may be implemented using a switch component such as a diode, a transistor, a field effect transistor, or micro-electro-mechanical systems (MEMS). For example, when the switch component in this application is implemented using MEMS, a specific circuit structure may be shown in FIG. 14.

Figure 14:
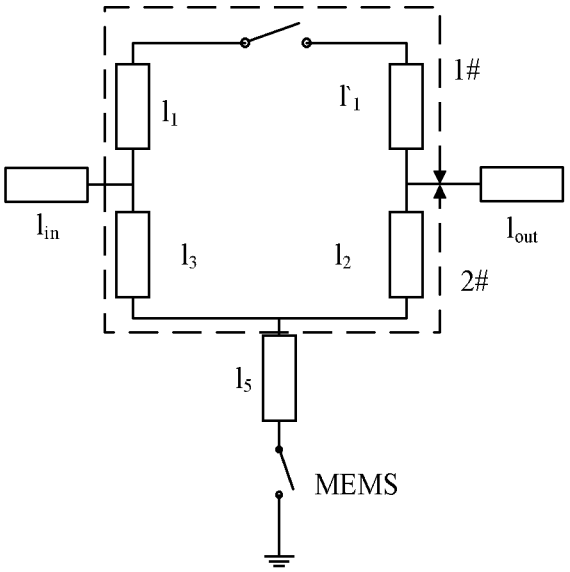
FIG. 14 is a schematic diagram of another embodiment of a phase shifter according to an embodiment of this application.

In FIG. 14, the switch $S_1$ and the switch $S_2$ each are implemented using an MEMS switch, and other components than the switch $S_1$ and the switch $S_2$ are similar to those in FIG. 6. Details are not described herein again. A diagram of an equivalent circuit is similar to FIG. 8A, FIG. 8B, and FIG. 10. Details are not described herein again.

When the MEMS switch is used for each of the first switch component and the second switch component, disconnection and connection of a transmission line may be controlled. In addition, because the MEMS switch has characteristics such as a quick response, intelligence, high operating efficiency, and high reliability, switching delay control of the phase shifter can be more accurate, and reliability of the phase shifter provided in this application can be improved.

In an optional implementation, in addition to one second switch component, the second branch may be further connected in parallel with a plurality of second switch components. "A plurality of" in this application means two or more. Correspondingly, the second branch further includes K fourth transmission lines. The K fourth transmission lines are connected in series. One terminal of the K fourth transmission lines connected in series is connected to the other terminal of the second transmission line, and the other terminal is connected to the one terminal of the third transmission line. One connection node is formed between every two adjacent transmission lines in the second transmission line, the K fourth transmission lines, and the third transmission line that are connected in series. The second transmission line, the K fourth transmission lines, and the third transmission line that are connected in series may be understood as K+2 transmission lines in total. Therefore, the K+2 transmission lines that are connected in series may form K+1 connection nodes. Correspondingly, there are K+1 groups of second switch components, and each group may include at least one second switch component. A group of second switch components may be a group of one or more same switch components, or may be a group of one or more different switch components. In addition, each of the K+1 groups of second switch components is in a one-to-one correspondence with each of the K+1 connection nodes, and one group of second switch components corresponds to one connection node. One terminal of each of the K+1 second switch components is connected to a corresponding connection node, and the other terminal is connected to a corresponding grounding component. K is an integer greater than or equal to 1.

In addition, when there are K+1 groups of second switch components, a quantity of corresponding fifth transmission lines may also be K+1, and at least one fifth transmission line may be disposed between each group of second switch components and a corresponding connection node.

Figure 15:
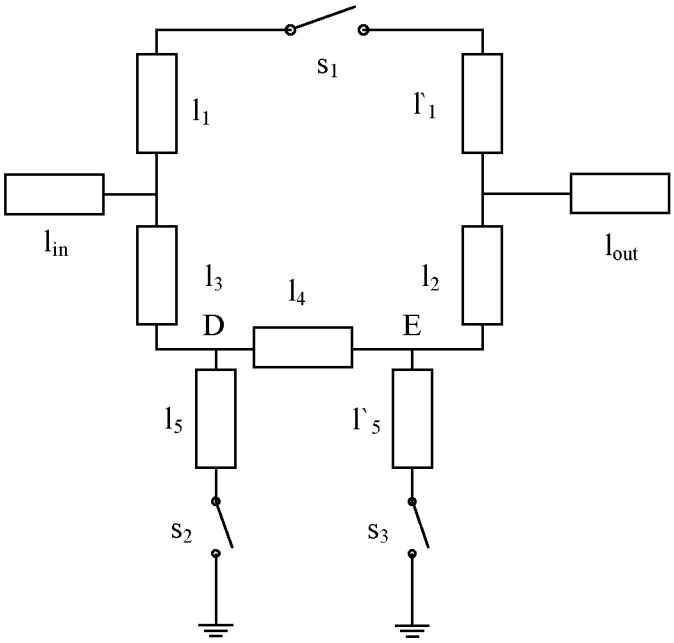
FIG. 15 is a schematic diagram of another embodiment of a phase shifter according to an embodiment of this application.

As shown in FIG. 15, an example in which the second branch is connected in parallel with two second switch components is used for description. The first branch includes a transmission line $l_1$ and a transmission line $l'_1$. The second branch includes a transmission line $l_2$, a transmission line $l_3$, a transmission line $l_4$, a transmission line $l_5$, and a transmission line $l'_5$. The transmission line $l_4$ is a fourth transmission line. The transmission line $l_5$ and the transmission line $l'_5$ are respectively two fifth transmission lines. A switch $S_1$ is connected in series on the first branch. One terminal of the switch $S_1$ is connected to the transmission line $l_1$, and the other terminal is connected to the transmission line $l'_1$. The second branch is connected in parallel with a switch $S_2$ and a switch $S_3$. One terminal of the switch $S_2$ is connected to a connection node D on the second branch using the transmission line $l_5$, and the other terminal of the switch $S_2$ is connected to a grounding component. One terminal of the switch $S_3$ is connected to a connection node E on the second branch using the transmission line $l'_5$, and the other terminal of the switch $S_2$ is connected to a grounding component. A working principle is similar to those shown in FIG. 6 to FIG. 10.

Lengths of the transmission line $l_1$, the transmission line $l'_1$, the transmission line $l_2$, the transmission line $l_3$, the transmission line $l_5$, the transmission line $l'_5$, and the transmission line $l_4$ are all less than or equal to a ⅛ wavelength of a radio frequency signal input from a radio frequency input transmission line $l_{in}$. Optionally, a physical length of the transmission line $l_1$, the transmission line $l'_1$, the transmission line $l_5$, or the transmission line $l'_5$ may be 0.

Figure 16A:
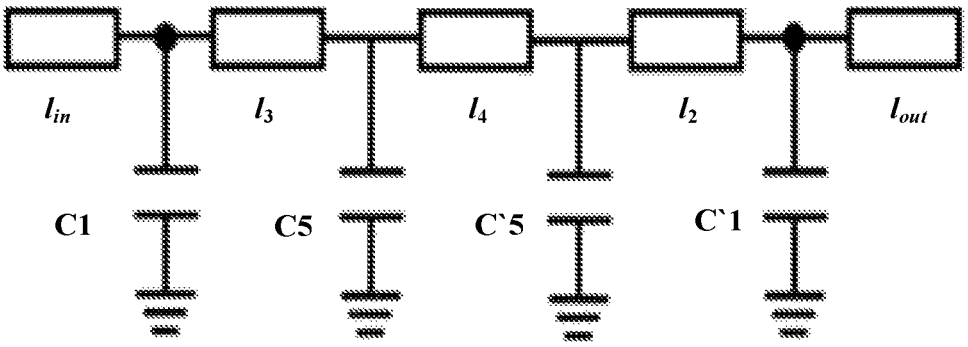
FIG. 16A is a schematic diagram of another embodiment of a phase shifter in a turning-off state according to an embodiment of this application.

When the switch $S_1$, the switch $S_2$, and the switch $S_3$ are all in a turning-off state, the first branch is opened-circuited, and the second branch is connected. A diagram of an equivalent circuit corresponding to FIG. 15 is shown in FIG. 16A. The transmission line $l_1$, the transmission line $l'_1$, the transmission line $l_5$, and the transmission line $l'_5$ are all open-circuited, and each may be equivalent to a capacitor. The transmission line $l_1$, the transmission line $l'_1$, the transmission line $l_5$, and the transmission line $l'_5$ each present a capacitor characteristic. The transmission line $l_1$ may be equivalent to a capacitor $C_1$, the transmission line $l'_1$ may be equivalent to a capacitor $C_2$, and the transmission line $l_5$ may be equivalent to a capacitor $C_5$. In addition, the transmission line $l'_5$ is equivalent to a capacitor $C'_5$. One terminal of the capacitor $C'_5$ is connected to the second branch, and the other terminal is grounded. The transmission line $l_1$, the transmission line $l'_1$, the transmission line $l_5$, and the transmission line $l'_5$ separately implement capacitor loading on the second branch such that a delay of the phase shifter is increased. When a radio frequency signal is input, the equivalent capacitors $C_1$, $C'_1$, $C_5$, and $C'_5$ implement capacitor loading on the second branch, and a phase is lagged.

Figure 16B:
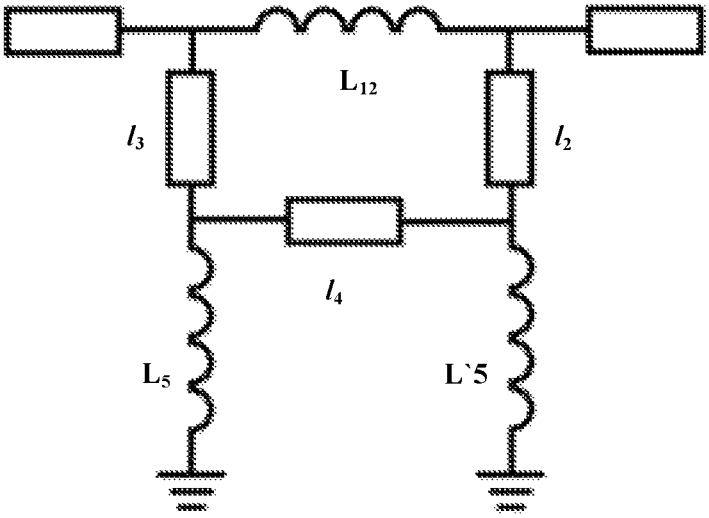
FIG. 16B is a schematic diagram of another embodiment of a phase shifter in a turning-on state according to an embodiment of this application.

When the switch $S_1$, the switch $S_2$, and the switch $S_3$ are all in a turning-on state, both the first branch and the second branch are connected. A diagram of an equivalent circuit corresponding to FIG. 15 is shown in FIG. 16B. The switch $S_1$ is turned on. The transmission line $l_1$ and the transmission line $l'_1$ are connected. The transmission line l1 and the transmission line l'1 may be equivalent to an inductor $L_1$. The transmission line $l_5$ is equivalent to an inductor $L_5$, and is connected in parallel with the first branch using the transmission line $l_2$ and the transmission line $l_3$. The transmission line $l'_5$ is equivalent to an inductor $L'_5$, and is connected in parallel with the first branch using the transmission line $l_2$ and the transmission line $l_3$. When a radio frequency signal is input, a phase is advanced due to inductor loading. In this case, the phase shifter has a band-pass characteristic or a high-pass characteristic, and allows a signal with a fixed frequency or a high frequency signal to pass through, and an equivalent electrical length of the phase shifter is less than a physical length.

Usually, the first switch component or the second switch component is not an ideal switch, and has parasitic parameters. These parasitic parameters may cause a phase shift amount of the phase shifter to decrease or a bandwidth of the phase shifter to narrow. In addition, when a structure of the phase shifter remains unchanged, a larger phase shift amount of the phase shifter indicates a smaller bandwidth of the phase shifter. Therefore, to improve the phase shift amount and widen the bandwidth, one or more switch components may be added on the basis of the phase shifter shown in FIG. 6 such that the bandwidth meets a requirement while the phase shift amount of the phase shifter is increased. For example, if it is determined that the phase shift amount is 180° and an operating frequency band is 3.3 GHz to 3.8 GHz, and a diode is used as a switch component, the basic structure shown in FIG. 6 may not meet design requirements of both the phase shift amount and the bandwidth. In this case, one or more switch components may be added. When all switch components in the phase shifter are in the turning-off state, it may be equivalent to that a shunt capacitor of the second branch is added, and the equivalent electrical length of the phase shifter is increased. Therefore, the phase shift amount and/or the bandwidth of the phase shifter can be adjusted.

Therefore, when a plurality of second switch components are connected in parallel with the second branch, a phase shifter may also be implemented, and phase shift may also be performed on the input radio frequency signal. Usually, when one second switch component connected in parallel with the second branch is added, an equivalent electrical length in a state in which both the first switch component and the second switch component are turned off may be increased, and an equivalent electrical length in a state in which both the first switch component and the second switch component are turned on may be reduced, thereby adjusting the phase shift amount, the bandwidth, and the like.

In an optional implementation, one first switch component may be connected in series on the first branch. In addition, a plurality of first switch components may be further connected in parallel with the first branch. "A plurality of" in this application means two or more. Correspondingly, the first branch also includes at least one first transmission line. When a plurality of first switch components are connected in series on the first branch, one terminal of an initial first transmission line is connected to the radio frequency input transmission line, and the other terminal is connected to one terminal of one of the at least one first switch component. One terminal of a second first transmission line is connected to the radio frequency output transmission line, and the other terminal is connected to one terminal of one of the at least one first switch component. One terminal of each of the at least one first switch component is connected to one terminal of one of the at least one first transmission line, and the other terminal of each first switch component is connected to one terminal of another of the at least one first transmission line.

Figure 17:
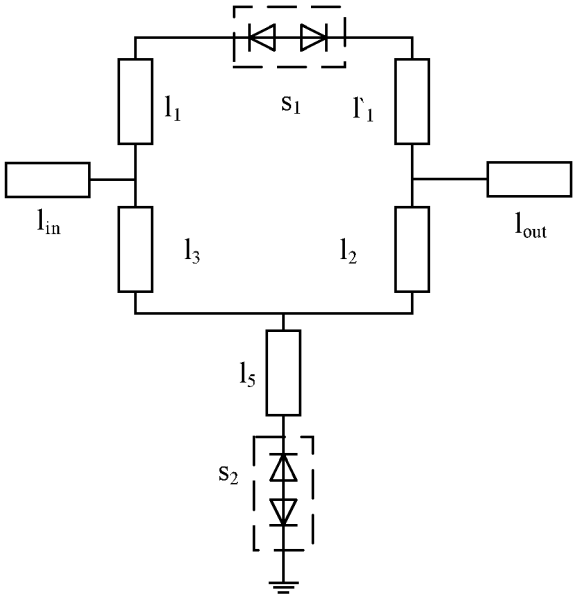
FIG. 17 is a schematic diagram of another embodiment of a phase shifter according to an embodiment of this application.

In an optional implementation, the switch component may include but is not limited to a diode, a transistor, or a field effect transistor that is encapsulated using a single die, a diode, a transistor, or a field effect transistor that is encapsulated using a plurality of dies, or the like. A diode encapsulated using dual dies is used as an example. As shown in FIG. 17, sides that are of diodes and that have same polarity may be connected during encapsulation. In addition, control signals input into the first switch component and the second switch component may also be generated by the RRU based on the beam information provided by the BBU.

A diagram of an equivalent circuit corresponding to FIG. 17 is similar to FIG. 8A, FIG. 8B, and FIG. 10. Details are not described herein again.

In this implementation of this application, the switch component may be implemented using the diode, the transistor, the field effect transistor, or the like that is encapsulated using the single die or the plurality of dies. Reliability of the switch component may be improved through encapsulation, thereby avoiding performance degradation, component damage, and the like of the switch component due to circuit corrosion, and improving stability of the phase shifter.

In an optional implementation, the first switch component and the second switch component in the phase shifter may include different components. For example, the first switch component may be a diode, and the second switch component may be a transistor. Alternatively, the first switch component may be a field effect transistor, and the second switch component may be a transistor. Alternatively, the first switch component may be MEMS, and the second switch component may be a diode. This may be adjusted based on an actual application scenario. In addition, the length of the transmission line may also be adjusted based on the first switch component and the second switch component.

In an optional implementation, when the first switch component and the second switch component in the phase shifter include different components, control signals input into all first switch components and/or second switch components may also be different. The RRU may generate, based on the beam information and the characteristics of the first switch component and the second switch component, different control signals for all the first switch components and second switch components, to accurately control the first switch component and the second switch component.

Figure 18:
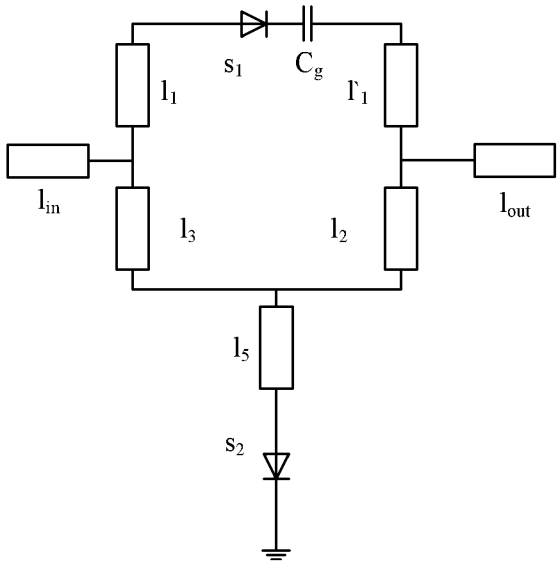
FIG. 18 is a schematic diagram of another embodiment of a phase shifter according to an embodiment of this application.

In an optional implementation, to prevent the control signals of the first switch component and the second switch component from being input into the two terminals of the first switch component and the second switch component at a same time, a DC blocking capacitor may be added to the branch. The first branch and a first part of the second branch form a loop. At least one DC blocking capacitor may be disposed on the loop. The first part is a part on the second branch other than a part between each connection node and a corresponding grounding component, and may be understood as a part that is on the second branch and that is connected from the radio frequency input transmission line $l_{in}$ to the radio frequency input transmission line $l_{out}$. For example, as shown in FIG. 18, the DC blocking capacitor may be added to the first branch. The switch $S_1$ is a diode, and the first branch includes an added DC blocking capacitor Cg. A control signal is input into each of the switch $S_1$ and the switch $S_2$ to control the switch $S_1$ and the switch $S_2$ to be turned off or turned on. When both the switch $S_1$ and the switch $S_2$ are turned on, because a direct current signal or a periodic square wave signal is input into each of the switch $S_1$ and the switch $S_2$, the transmission line $l_1$, the transmission line $l'_1$, the transmission line $l_2$, and the transmission line $l_3$ may form a direct current loop. Consequently, the switch $S_1$ and the switch $S_2$ cannot be correctly controlled to be turned off or turned on. Therefore, the DC blocking capacitor may be added to a loop formed by the transmission line $l_1$, the transmission line $l'_1$, the transmission line $l_2$, and the transmission line $l_3$, and there may be one or more DC blocking capacitors. This is not limited herein.

Therefore, the phase shifter provided in this implementation of this application may effectively control the first switch component and the second switch component by adding the DC blocking capacitor. In particular, in a scenario in which the first switch component and the second switch component each are a diode, a transistor, a field effect transistor, or the like, the following case can be avoided. The first switch component and the second switch component cannot be controlled due to the closed loop formed because the control signal is a direct current or periodic square wave, thereby improving reliability of the phase shifter.

In an optional implementation, the switch in the phase shifter may be implemented as a co-polar switch component pair that can be turned on or off, including but not limited to a co-polar diode pair, a co-polar transistor pair, or a co-polar field-effect transistor pair. That is, the at least one first switch component in this implementation of this application may be divided into M pairs of first switch components. In each pair of first switch components, one terminal of one first switch component is connected to one terminal of the other first switch component. Polarity of two terminals that are connected to each other and that are of one pair of first switch components is the same. M is an integer greater than or equal to 1. Similarly, the at least one second switch component in this implementation of this application may be divided into N pairs of second switch components. In each pair of second switch components, one terminal of one second switch component is connected to one terminal of the other second switch component. Polarity of two terminals that are connected to each other and that are of one pair of second switch components is the same. N is an integer greater than or equal to 1.

Figure 19:
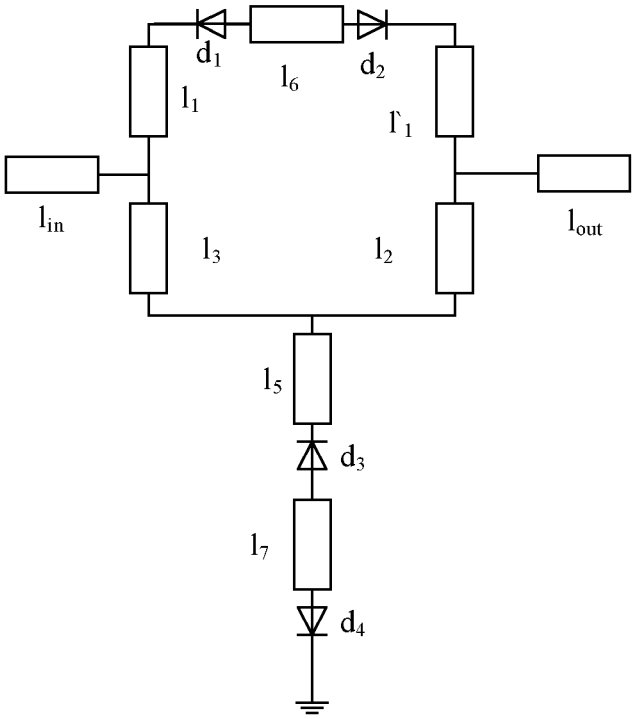
FIG. 19 is a schematic diagram of another embodiment of a phase shifter according to an embodiment of this application.

Further, as shown in FIG. 19, the co-polar diode pair is used as an example. Terminals that are of every two diodes and that have same polarity are connected. Optionally, the terminals that are of every two diodes and that have same polarity may be directly connected, or the terminals that are of every two diodes and that have same polarity may be connected using a transmission line. As shown in FIG. 19, a diode $d_1$ is connected to a diode $d_2$ using a transmission line $l_6$, and a diode $d_3$ is connected to a diode $d_4$ using a transmission line $l_7$. Optionally, lengths of the transmission lines $l_6$ and $l_7$ may be 0. A specific working principle is similar to that in FIG. 12, and details are not described herein.

Figure 20:
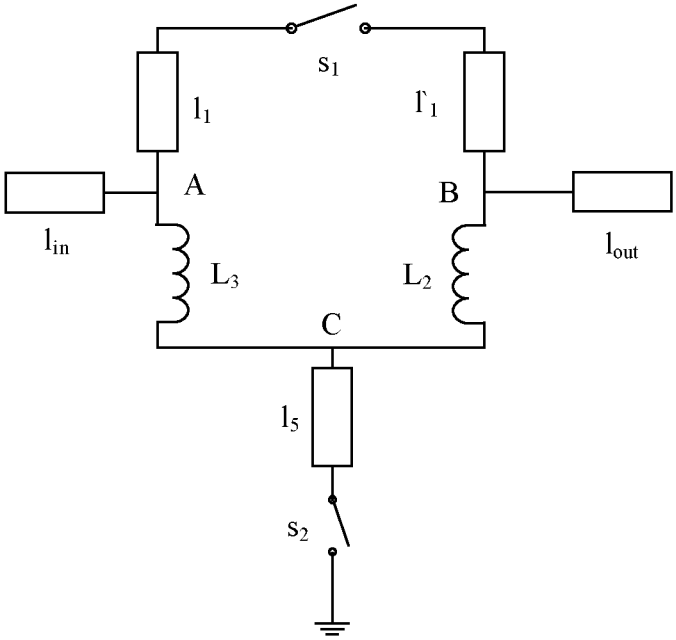
FIG. 20 is a schematic diagram of another embodiment of a phase shifter according to an embodiment of this application.

In an optional implementation, the transmission line in this implementation of this application may also be implemented using a lumped inductor or a lumped capacitor. That is, the first transmission line, the second transmission line, the third division transmission line, the fourth transmission line, the fifth transmission line, and the like each may be a lumped inductor or a lumped capacitor. For example, an implementation of the lumped inductor may be shown in FIG. 20. For example, lumped inductors $L_2$ and $L_3$ may replace the transmission lines $l_2$ and $l_3$ in FIG. 6. Further, parameters of the lumped inductors $L_1$ and $L_2$ may be calculated based on the phase shift amount, the bandwidth, the impedance of the transmission line, and the like, for example, inductance, an allowable deviation, a quality factor, a distributed capacitance, and a rated current of the lumped inductor, to determine the parameters of the lumped inductor that replaces the transmission line. In this implementation of this application, the transmission line is replaced using the lumped capacitor, the lumped inductor, or another manner. In this way, when an operating frequency is relatively low, the size of the phase shifter can be further reduced, and stability of the phase shifter can be improved such that parameters such as the phase shift amount and the bandwidth of the phase shifter are more accurate.

Figure 21:
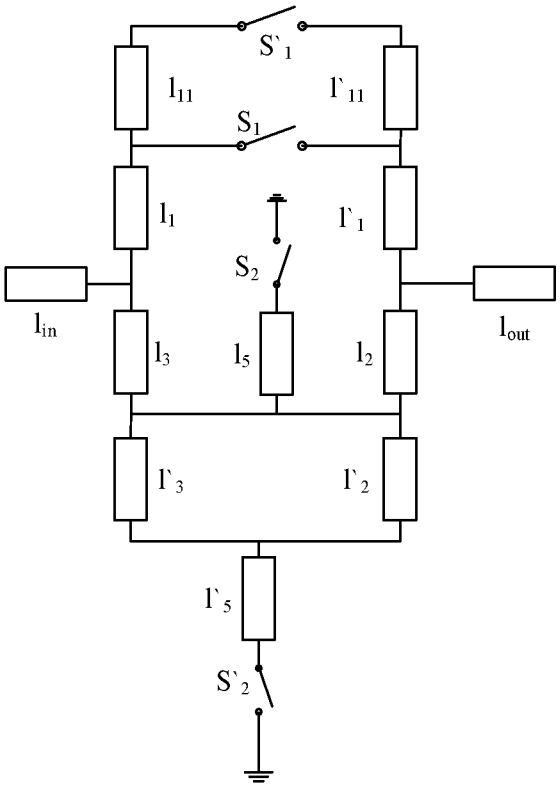
FIG. 21 is a schematic diagram of another embodiment of a phase shifter according to an embodiment of this application.

In an optional implementation, in addition to the two branches shown in FIG. 6 to FIG. 20, branches connected in parallel between the radio frequency input transmission line and the radio frequency output transmission line may further include more branches. For example, referring to FIG. 21, four branches are used as an example. A transmission line $l_1$, a transmission line $l'_1$, and a switch $S_1$ may form a first branch. A transmission line $l_2$, a transmission line $l_3$, and a switch $S_2$ may form a second branch. A transmission line $l_{11}$ and a transmission line $l'_{11}$ may form a third branch. A transmission line $l'_3$ and a transmission line $l'_4$ may form a fourth branch. The switch $S_1$ is connected in series on the first branch. One terminal of the switch $S_1$ is connected to the transmission line $l_1$, and the other terminal is connected to the transmission line $l'_1$. The switch $S_2$ is connected in parallel with the second branch. One terminal of the switch $S_2$ is connected to the second branch using a transmission line $l_5$, and the other terminal is connected to a grounding component. A switch $S'_1$ is connected in series on the third branch. One terminal of the switch $S'_1$ is connected to the transmission line $l_{11}$, and the other terminal is connected to the transmission line $l'_{11}$. A switch $S'_2$ is connected in parallel with the fourth branch. One terminal of the switch $S'_2$ is connected to the second transmission branch using a transmission line $l'_5$, and the other terminal is connected to a grounding component. When all the switches are turned on or off, an equivalent circuit is similar to the equivalent circuit corresponding to FIG. 6. When the switches $S_1$, $S'_1$, $S_2$, and $S'_2$ are all turned off, it is equivalent to that a capacitor is connected in parallel with each of the second branch and the fourth branch such that an equivalent electrical length of the phase shifter is increased, a phase is lagged, and the phase shifter presents a low-pass characteristic. When the switches $S_1$, $S'_1$, $S_2$, and $S'_2$ are all turned on, it is equivalent to that an inductor is connected in parallel with each of the first transmission line and the third branch. It may be understood that a transmission electrical length of an input signal on which phase shift is to be performed is reduced, a phase is advanced, and the phase shifter presents a band-pass characteristic or a high-pass characteristic. The phase shifter implements phase shift on the input radio frequency signal through switching between the band-pass characteristic/the high-pass characteristic and the low-pass characteristic of the phase shifter.

The foregoing embodiments are merely intended for describing the technical solutions of this application, but not for limiting this application. Although this application is described in detail with reference to the foregoing embodiments, persons of ordinary skill in the art should understand that they may still make modifications to the technical solutions described in the foregoing embodiments or make equivalent replacements to some technical features thereof, without departing from the scope of the technical solutions of the embodiments of this application.

What is claimed is:

1. A phase shifter comprising:

a radio frequency input transmission line;

a radio frequency output transmission line;

a first branch located between the radio frequency input transmission line and the radio frequency output transmission line and comprising:

a first switch component; and a first transmission line coupled with the first switch component in series; and a second branch coupled to the first branch in parallel, located between the radio frequency input transmission line and the radio frequency output transmission line, and comprising:

a second transmission line comprising:

a first terminal coupled to the radio frequency input transmission line;

a second terminal; and a first connection node;

a third transmission line comprising:

a third terminal coupled to the second terminal; and a fourth terminal coupled to the radio frequency output transmission line, wherein a first length of the first transmission line, a second length of the second transmission line, and a third length of the third transmission line are all less than or equal to ⅛ of a wavelength of a radio frequency signal input from the radio frequency input transmission line;

a grounding component; and a second switch component coupled to the grounding component and comprising:

a fifth terminal coupled to the first connection node and the third transmission line; and a sixth terminal coupled to the grounding component, wherein the second branch functions as a shunt inductor of the first branch when the first switch component and the second switch component are turned on at a same time, and wherein the first branch functions as a shunt capacitor of the second branch when the first switch component and the second switch components are turned off at the same time.

2. The phase shifter of claim 1, wherein the second branch further comprises K fourth transmission lines coupled in series and comprising:

a seventh terminal coupled to the second terminal; and an eighth terminal coupled to the third terminal, wherein every two adjacent transmission lines in the second transmission line, the K fourth transmission lines, and the third transmission line coupled in series form a second connection node, wherein a quantity of second connection nodes and second switch components is K+1, wherein K is an integer greater than or equal to 1, wherein the second switch components are in a one-to-one correspondence with the second connection nodes, and wherein each of the fifth terminal is coupled to a corresponding second connection node.

3. The phase shifter of claim 2, wherein a fourth length of each of the K fourth transmission lines is less than ⅛ a wavelength of a radio frequency signal input from the radio frequency input transmission line.

4. The phase shifter of claim 2, wherein the second branch further comprises a fifth transmission line between each of the second switch components and the corresponding second connection node.

5. The phase shifter of claim 4, wherein a fifth length of the fifth transmission line is less than ⅛ a wavelength of a radio frequency signal input from the radio frequency input transmission line.

6. The phase shifter of claim 5, wherein the first branch and a first part of the second branch form a loop, wherein the loop comprises a direct current (DC) blocking capacitor, and wherein the first part is a part on the second branch other than a part between each of the second connection nodes and the grounding component.

7. The phase shifter of claim 1, wherein the first transmission line comprises:

a ninth terminal coupled to the radio frequency input transmission line; and a tenth terminal, wherein the first switch component comprises:

an eleventh terminal coupled to the tenth terminal; and a twelfth terminal.

8. The phase shifter of claim 7, wherein another first transmission line comprises:

a thirteenth terminal coupled to the radio frequency output transmission line; and a fourteenth terminal coupled to the twelfth terminal.

9. The phase shifter of claim 1, wherein the first switch component comprises:

a fifteenth terminal; and a sixteenth terminal, wherein the first transmission line comprises a seventeenth terminal coupled to the fifteenth terminal, and wherein another first transmission line comprises an eighteenth terminal coupled to the sixteenth terminal.

10. The phase shifter of claim 1, wherein the first switch component comprises M pairs of first switch components, wherein, in a first pair of the M pairs, one terminal of one first switch component is coupled to another terminal of another first switch component, wherein polarity of the terminal and the other terminal is the same, and wherein M is an integer greater than or equal to 1.

11. The phase shifter of claim 1, wherein the second switch component comprises N pairs of second switch components, wherein, in a second pair of the N pairs, one terminal of one second switch component is coupled to another terminal of another second switch component, wherein polarity of the terminal and the other terminal is the same, and wherein N is an integer greater than or equal to 1.

12. The phase shifter of claim 11, wherein the first transmission line or the second transmission line is a lumped inductor.

13. The phase shifter of claim 11, wherein the third transmission line is a lumped inductor.

14. The phase shifter of claim 1, wherein the first transmission line, the second transmission line, or the third transmission line is a lumped inductor.

15. A phase shifter comprising:

a radio frequency input transmission line;

a radio frequency output transmission line;

a first branch located between the radio frequency input transmission line and the radio frequency output transmission line and comprising a first switch component; and a second branch coupled to the first branch in parallel, located between the radio frequency input transmission line and the radio frequency output transmission line, and comprising:

a first transmission line comprising:

a first terminal coupled to the radio frequency input transmission line; and a second terminal;

a second transmission line comprising:

a third terminal coupled to the second terminal; and a fourth terminal coupled to the radio frequency output transmission line, wherein both a first length of the first transmission line and a second length of the second transmission line are less than or equal to ⅛ of a wavelength of a radio frequency signal input from the radio frequency input transmission line;

a grounding component; and a second switch component coupled to the grounding component and comprising:

a fifth terminal coupled between the second terminal and the third terminal to form a first connection node; and a sixth terminal coupled to the grounding component, wherein the second branch functions as a shunt inductor of the first branch when the first switch component and the second switch component are turned on at a same time, and wherein the first branch functions as a shunt capacitor of the second branch when the first switch component and the second switch components are turned off at the same time.

16. An antenna system comprising:

a phase shifter comprising:

a radio frequency input transmission line;

a radio frequency output transmission line;

a first branch located between the radio frequency input transmission line and the radio frequency output transmission line and comprising:

a first switch component; and a first transmission line coupled with the first switch component in series; and a second branch coupled to the first branch in parallel, located between the radio frequency input transmission line and the radio frequency output transmission line, and comprising:

a second transmission line comprising:

a first terminal coupled to the radio frequency input transmission line;

a second terminal; and a first connection node;

a third transmission line comprising:

a third terminal coupled to the second terminal; and a fourth terminal coupled to the radio frequency output transmission line, wherein a first length of the first transmission line, a second length of the second transmission line, and a third length of the third transmission line are all less than or equal to ⅛ of a wavelength of a radio frequency signal input from the radio frequency input transmission line;

a grounding component; and a second switch component coupled to the grounding component and comprising:

a fifth terminal coupled to the first connection node and the third transmission line; and a sixth terminal coupled to the grounding component, wherein the second branch functions as a shunt inductor of the first branch when the first switch component and the second switch component are turned on at a same time, and wherein the first branch functions as a shunt capacitor of the second branch when the first switch component and the second switch components are turned off at the same time; and an antenna coupled to the radio frequency output transmission line.

17. The antenna system of claim 16, wherein the first transmission line, the second transmission line, or the third transmission line is a lumped inductor.

18. A communications device comprising:

a baseband system;

a radio frequency system comprising a signal transceiver channel comprising:

an input end coupled to the baseband system; and an output end coupled to a radio frequency input transmission line of a phase shifter in an antenna system, wherein the phase shifter comprises:

a radio frequency output transmission line;

a first branch located between the radio frequency input transmission line and the radio frequency output transmission line and comprising:

a first switch component; and a first transmission line coupled with the first switch component in series; and a second branch coupled to the first branch in parallel, located between the radio frequency input transmission line and the radio frequency output transmission line, and comprising:

a second transmission line comprising:

a first terminal coupled to the radio frequency input transmission line;

a second terminal; and a first connection node;

a third transmission line comprising:

a third terminal coupled to the second terminal; and a fourth terminal coupled to the radio frequency output transmission line, wherein a first length of the first transmission line, a second length of the second transmission line, and a third length of the third transmission line are all less than or equal to ⅛ of a wavelength of a radio frequency signal input from the radio frequency input transmission line;

a grounding component; and a second switch component coupled to the grounding component and comprising:

a fifth terminal coupled to the first connection node and the third transmission line; and a sixth terminal coupled to the grounding component, wherein the second branch functions as a shunt inductor of the first branch when the first switch component and the second switch component are turned on at a same time, and wherein the first branch functions as a shunt capacitor of the second branch when the first switch component and the second switch components are turned off at the same time; and an antenna coupled to the radio frequency output transmission line.

19. The communications device of claim 18, wherein the first switch component comprises M pairs of first switch components, wherein, in a first pair of the M pairs, one terminal of one first switch component is coupled to another terminal of another first switch component, wherein polarity of the terminal and the other terminal is the same, and wherein M is an integer greater than or equal to 1.

20. The communications device of claim 18, wherein the first transmission line, the second transmission line, or the third transmission line is a lumped inductor.

* * * * *